US012680029B2

(12) United States Patent
Koseoglu

(10) Patent No.: US 12,680,029 B2
(45) Date of Patent: Jul. 14, 2026

(54) GENERATING HYDROGEN FROM REFINERY WASTE AND CONSUMER WASTE PLASTIC FOR SUPPLY TO HYDROPROCESSING

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 248 days.

(21) Appl. No.: 18/658,374

(22) Filed: May 8, 2024

(65) Prior Publication Data

US 2025/0346818 A1 Nov. 13, 2025

(51) Int. Cl.
*C10G 2/00* (2006.01)
*C10J 3/48* (2006.01)
(Continued)

(52) U.S. Cl.
CPC ..... *C10G 2/50* (2013.01); *C10J 3/48* (2013.01); *C25B 1/04* (2013.01); *C25B 15/081* (2021.01);
(Continued)

(58) Field of Classification Search
CPC ..... C10G 2/50; C10G 2300/4006; C10G 2300/4012; C10G 2300/4018; C10G 2300/4043; C10G 2300/42; C10J 3/48; C10J 2300/0946; C10J 2300/0959; C10J 2300/0976; C10J 2300/0989; C10J 2300/1659; C25B 1/04; C25B 15/081
See application file for complete search history.

(56) References Cited

U.S. PATENT DOCUMENTS 8,187,349 B2 5/2012 Jancker et al.
8,685,119 B2 4/2014 Van Den Berg et al.
(Continued)

FOREIGN PATENT DOCUMENTS

AU 2022271852 A1 * 12/2023 ..... C10K 3/026

OTHER PUBLICATIONS

Jafarian et al., "Emerging technologies for catalytic gasification of petroleum residue derived fuels for sustainable and cleaner fuel production—An overview," Energy Reports, 2023, 9:3248-3272, 25 pages.

*Primary Examiner* — Ellen M McAvoy
(74) *Attorney, Agent, or Firm* — Fish & Richardson P.C.

(57) ABSTRACT

Electrical power derived from a renewable energy source is used to perform electrolysis of water to produce oxygen and hydrogen. A feed stream includes consumer waste plastics, a waste stream from a hydrocarbon refinery, or both. The feed stream is partially oxidized to produce syngas. At least a portion of the carbon monoxide of the syngas is reacted with water to produce additional carbon dioxide and hydrogen. A hydrocarbon feed stream is hydroprocessed using at least a portion of the hydrogen generated by electrolysis and at least a portion of the hydrogen from the syngas to produce a hydroprocessing product stream including a saturated hydrocarbon. At least a portion of the carbon dioxide of the syngas is hydrogenated using at least a portion of the hydrogen generated by electrolysis to produce a product stream including a hydrocarbon, an oxygenate, or both.

19 Claims, 5 Drawing Sheets

(51) Int. Cl.
*C25B 1/04* (2021.01)
*C25B 15/08* (2006.01)

(52) U.S. Cl.
CPC ..... *C10G 2300/4006* (2013.01); *C10G 2300/4012* (2013.01); *C10G 2300/4018* (2013.01); *C10G 2300/4043* (2013.01); *C10G 2300/42* (2013.01); *C10J 2300/0946* (2013.01); *C10J 2300/0959* (2013.01); *C10J 2300/0976* (2013.01); *C10J 2300/0989* (2013.01); *C10J 2300/1659* (2013.01)

(56) References Cited

U.S. PATENT DOCUMENTS 9,056,771 B2 6/2015 Koseoglu et al.
9,234,146 B2 1/2016 Koseoglu
9,359,917 B2 6/2016 Koseoglu et al.
10,472,573 B2 11/2019 Ge et al.
11,104,851 B2 8/2021 Koseoglu et al.
11,370,973 B2 6/2022 Koseoglu et al.
11,491,468 B2 11/2022 Stewart et al.
11,896,959 B2 2/2024 Matsumoto et al.
12,325,634 B2 * 6/2025 Ravikumar ..... C10K 1/005
2013/0334060 A1 * 12/2013 Koseoglu ..... C10K 3/04 205/637
2022/0109173 A1 4/2022 Gomez
2022/0112429 A1 4/2022 Greager et al.
2023/0150823 A1 5/2023 Schuetzle et al.
2023/0226531 A1 7/2023 Koseoglu et al.
2023/0242822 A1 8/2023 Schuetzle et al.
2023/0340347 A1 10/2023 Bucher et al.
2025/0313520 A1 * 10/2025 Quintero ..... C25B 13/07
2025/0346544 A1 * 11/2025 Koseoglu ..... C10G 9/36

* cited by examiner

200

300

400

GENERATING HYDROGEN FROM REFINERY WASTE AND CONSUMER WASTE PLASTIC FOR SUPPLY TO HYDROPROCESSING

TECHNICAL FIELD

This disclosure relates to hydrocarbon hydroprocessing.

BACKGROUND

Carbon is an abundant element in the Earth's crust. Carbon's abundance, its diversity in the makeup of organic compounds, and its ability to form polymers at temperatures commonly encountered on Earth allows this element to serve as a common element of all known life. The atoms of carbon can bond together in numerous ways, resulting in various allotropes of carbon. Some examples of allotropes of carbon include graphite, diamond, amorphous carbon, carbon nanotubes, carbon fibers, and fullerenes. The physical properties of carbon vary widely based on the allotropic form. As such, carbon is widely used across various markets at commercial or near-commercial scales.

Hydrogen is the lightest element. At standard conditions, hydrogen is a gas of diatomic molecules and is colorless, odorless, tasteless, non-toxic, and combustible. Hydrogen is the most abundant chemical substance in the universe. Most of the hydrogen on Earth exists in molecular forms, such as in water and in organic compounds (such as hydrocarbons). Some examples of uses of hydrogen include fossil fuel processing (for example, hydrocracking) and ammonia production.

There is a growing interest in the energy transition from fossil fuels to renewable energy and sustainable energy in a global effort to reduce carbon emissions. Some examples of decarbonisation pathways in the energy transition to renewable energy include increasing energy efficiency, producing and/or using lower-carbon fuels, and carbon capture and storage (CCS).

SUMMARY

This disclosure describes technologies relating to hydrocarbon hydroprocessing. Certain aspects of the subject matter can be implemented as a method. An electrolysis unit receives electrical power derived from a renewable energy source. The electrolysis unit splits water into oxygen and hydrogen using the received electrical power to produce an oxygen stream including the oxygen and a hydrogen stream including the hydrogen. A gasification unit partially oxidizes a gasification feed stream using at least a portion of the oxygen stream to produce a syngas stream including carbon dioxide, carbon monoxide, and hydrogen. The gasification feed stream includes consumer waste plastics, a waste stream from a hydrocarbon refinery, or both. The hydrocarbon refinery is configured to receive crude oil and separate the crude oil into a plurality of components. At least one of the plurality of components is the waste stream. A water-gas shift unit reacts at least a portion of the carbon monoxide of the syngas stream with water to produce additional carbon dioxide and hydrogen, thereby producing a shifted syngas stream that has a greater hydrogen content than the syngas stream. A hydroprocessing unit reacts a hydrocarbon feed stream with at least a portion of the hydrogen of the shifted syngas stream and a first portion of the hydrogen stream produced by the electrolysis unit to remove non-carbon impurities from the hydrocarbon feed stream and break carbon-carbon bonds in the hydrocarbon feed stream, thereby producing a hydroprocessing product stream including a saturated hydrocarbon. A hydrogenation reactor hydrogenates at least a portion of the carbon dioxide of the shifted syngas stream using a second portion of the hydrogen stream produced by the electrolysis unit to produce a product stream including a hydrocarbon, an oxygenate, or both.

This, and other aspects, can include one or more of the following features. In some implementations, the consumer waste plastics include polystyrene, polyphenylene, poly(p-xylene), poly(phenylenevinylene), polybenzyl-type polymer, polyethene, polyethylene terephthalate, polyolefin, polypropylene, polyvinyl chloride, polyamide, polycarbonate, polyurethane, polyester, natural rubber, synthetic rubber, acrylonitrile butadiene styrene, polyethylene/acrylonitrile butadiene styrene, polycarbonate/acrylonitrile butadiene styrene, maleimide/bismaleimide, melamine formaldehyde, phenol formaldehyde, polyepoxide, polyetheretherketone, polyetherimide, polyimide, polylactic acid, polymethyl methacrylate, polytetrafluoroethylene, urea-formaldehyde, diphenylcarbonate, polyether sulfone, polyacrylonitrile, or any combinations of these. In some implementations, the waste stream from the hydrocarbon refinery includes a mercaptan oxidation waste stream including disulfide oil, a delayed coking waste stream including fuel grade coke, a vacuum distillation waste stream including vacuum residue, a solvent deasphalting waste stream including asphalt, an aromatics recovery waste stream including aromatics recovery bottoms, fuel oil, residual oil, tar, wax, or any combinations of these. In some implementations, the method includes deriving the electrical power from the renewable energy source. In some implementations, the renewable energy source includes solar energy, wind energy, tidal energy, hydropower, geothermal energy, or any combinations of these. In some implementations, the carbon dioxide of the shifted syngas stream is hydrogenated at a hydrogenation operating temperature in a range of from about 150 degrees Celsius (° C.) to about 450° C. In some implementations, the carbon dioxide of the shifted syngas stream is hydrogenated at a hydrogenation operating pressure in a range of from about 200 kilopascals (kPa) to about 6,000 kPa. In some implementations, a hydrogen-to-carbon dioxide molar ratio of the second portion of the hydrogen stream and the carbon dioxide of the shifted syngas stream entering the hydrogenation reactor is in a range of from about 2:1 to about 10:1. In some implementations, the second portion of the hydrogen stream and the carbon dioxide of the shifted syngas stream have a gas hourly space velocity in the hydrogenation reactor in a range of from about 5,000 per hour ($h^{-1}$) to about 30,000 $h^{-1}$. In some implementations, the gasification feed stream is partially oxidized by the gasification unit at a gasification operating pressure in a range of from about 2,000 kilopascals (kPa) to about 6,000 kPa. In some implementations, the gasification feed stream is partially oxidized by the gasification unit at a gasification operating temperature in a range of from about 800 degrees Celsius (° C.) to about 1,800° C. In some implementations, an oxygen-to-carbon molar ratio of the portion of the oxygen stream entering the gasification unit in relation to the gasification feed stream entering the gasification unit in a range of from about 1:25 to about 2:1. In some implementations, the gasification feed stream includes steam. In some implementations, the gasification feed stream entering the gasification unit has a steam-to-carbon weight ratio in a range of from about 1:100 to about 10:1. In some implementations, the hydrocarbon feed stream is reacted with at least the portion of the hydrogen of the shifted syngas stream and the first portion of the hydrogen stream at a hydroprocessing operating temperature in a range of from about 150° C. to about 450° C. In some implementations, the hydrocarbon feed stream is reacted with at least the portion of the hydrogen of the shifted syngas stream and the first portion of the hydrogen stream at a hydroprocessing operating pressure in a range of from about 2,000 kPa to about 20,000 kPa. In some implementations, the hydrocarbon feed stream has a liquid hourly space velocity in the hydroprocessing unit in a range of from about 0.1 per hour ($h^{-1}$) to about 10 $h^{-1}$.

Certain aspects of the subject matter described can be implemented as a system. The system includes an electrolysis unit. The electrolysis unit is configured to receive a water stream and electrical power derived from a renewable energy source. The electrolysis unit is configured to use the electrical power to perform electrolysis on the water stream to produce an oxygen stream including oxygen and a hydrogen stream including hydrogen. The system includes a gasification unit configured to receive a gasification feed stream including consumer waste plastics, a waste stream from a hydrocarbon refinery, or both. The gasification unit is configured to partially oxidize the gasification feed stream using at least a portion of the oxygen stream produced by the electrolysis unit to produce a syngas stream including carbon dioxide, carbon monoxide, and hydrogen. The system includes a water-gas shift unit configured to receive the syngas stream from the gasification unit. The water-gas shift unit is configured to react at least a portion of the carbon monoxide of the syngas stream with water to produce additional carbon dioxide and hydrogen, thereby producing a shifted syngas stream. The shifted syngas stream has a greater hydrogen content in comparison with the syngas stream. The system includes a hydroprocessing unit configured to receive a hydrocarbon feed stream, at least a portion of the hydrogen of the shifted syngas stream, and a first portion of the hydrogen stream produced by the electrolysis unit. The hydroprocessing unit is configured to react the hydrocarbon feed stream with the hydrogen of the shifted syngas stream and the first portion of the hydrogen stream to remove non-carbon impurities from the hydrocarbon feed stream and break carbon-carbon bonds in the hydrocarbon feed stream, thereby producing a hydroprocessing product stream including a saturated hydrocarbon. The system includes a hydrogenation unit configured to receive at least a portion of the carbon dioxide of the shifted syngas stream and a second portion of the hydrogen stream produced by the electrolysis unit. The hydrogenation unit is configured to hydrogenate at least the portion of the carbon dioxide of the shifted syngas stream using the second portion of the hydrogen stream, thereby producing a product stream including a hydrocarbon, an oxygenate, or both.

This, and other aspects, can include one or more of the following features. In some implementations, the system includes the gasification feed stream. In some implementations, the consumer waste plastics include polystyrene, polyphenylene, poly(p-xylene), poly(phenylenevinylene), polybenzyl-type polymer, polyethene, polyethylene terephthalate, polyolefin, polypropylene, polyvinyl chloride, polyamide, polycarbonate, polyurethane, polyester, natural rubber, synthetic rubber, acrylonitrile butadiene styrene, polyethylene/acrylonitrile butadiene styrene, polycarbonate/acrylonitrile butadiene styrene, maleimide/bismaleimide, melamine formaldehyde, phenol formaldehyde, polyepoxide, polyetheretherketone, polyetherimide, polyimide, polylactic acid, polymethyl methacrylate, polytetrafluoroethylene, urea-formaldehyde, diphenylcarbonate, polyether sulfone, polyacrylonitrile, or any combinations of these. In some implementations, the system includes the hydrocarbon refinery. In some implementations, the hydrocarbon refinery is configured to receive and separate crude oil into a plurality of components. In some implementations, at least one of the plurality of components is the waste stream. In some implementations, the waste stream from the hydrocarbon refinery includes a mercaptan oxidation waste stream including disulfide oil, a delayed coking waste stream including fuel grade coke, a vacuum distillation waste stream including vacuum residue, a solvent deasphalting waste stream including asphalt, an aromatics recovery waste stream including aromatics recovery bottoms, fuel oil, residual oil, tar, wax, or any combinations of these. In some implementations, the system includes the electrical power derived from the renewable energy source. In some implementations, the renewable energy source includes solar energy, wind energy, tidal energy, hydropower, geothermal energy, or any combinations of these. In some implementations, the hydrogenation reactor is configured to hydrogenate at least the portion of the carbon dioxide of the shifted syngas stream at a hydrogenation operating temperature in a range of from about 150° C. to about 450° C. In some implementations, the hydrogenation reactor is configured to hydrogenate at least the portion of the carbon dioxide of the shifted syngas stream at a hydrogenation operating pressure in a range of from about 200 kPa to about 6,000 kPa. In some implementations, a hydrogen-to-carbon dioxide molar ratio of the second portion of the hydrogen stream and the carbon dioxide of the shifted syngas stream entering the hydrogenation reactor is in a range of from about 2:1 to about 10:1. In some implementations, the second portion of the hydrogen stream and the carbon dioxide of the shifted syngas stream have a gas hourly space velocity in the hydrogenation reactor in a range of from about 5,000 per hour ($h^{-1}$) to about 30,000 $h^{-1}$. In some implementations, the gasification unit is configured to partially oxidize the gasification feed stream at a gasification operating pressure in a range of from about 2,000 kilopascals (kPa) to about 6,000 kPa. In some implementations, the gasification unit is configured to partially oxidize the gasification feed stream at a gasification operating temperature in a range of from about 800 degrees Celsius (° C.) to about 1,800° C. In some implementations, an oxygen-to-carbon molar ratio of the portion of the oxygen stream entering the gasification unit in relation to the gasification feed stream entering the gasification unit in a range of from about 1:25 to about 2:1. In some implementations, the gasification feed stream includes steam. In some implementations, the gasification feed stream entering the gasification unit has a steam-to-carbon weight ratio in a range of from about 1:100 to about 10:1. In some implementations, the hydroprocessing unit includes a hydrotreater, a hydrocracker, or both. In some implementations, the hydroprocessing unit is configured to operate at a hydroprocessing operating temperature in a range of from about 150° C. to about 450° C. In some implementations, the hydroprocessing unit is configured to operate at a hydroprocessing operating pressure in a range of from about 2,000 kPa to about 20,000 kPa. In some implementations, the hydrocarbon feed stream has a liquid hourly space velocity in the hydroprocessing unit in a range of from about 0.1 per hour ($h^{-1}$) to about 10 $h^{-1}$.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1A:
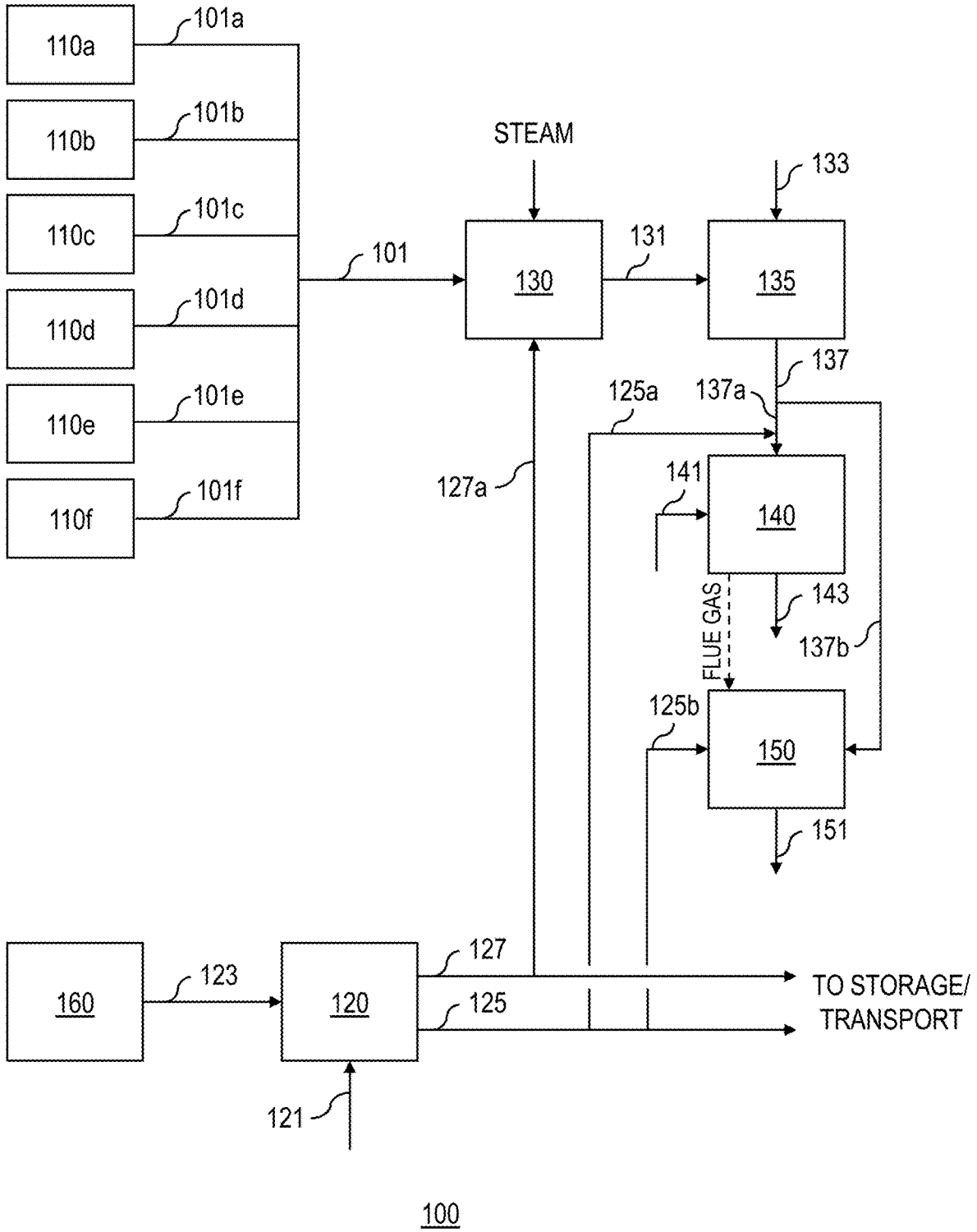
FIG. 1A is a schematic diagram of an example system for producing hydrogen from waste products and for producing useful chemicals using the produced hydrogen.

This disclosure describes generation of hydrogen from refinery and consumer waste. The hydrogen generated can, for example, be used in hydroprocessing, as fuel, as feedstock to generate other useful chemicals (such as methanol), or any combinations of these. The hydrogen is generated by gasification of various refinery waste streams and consumer waste. Gasification of the refinery waste and consumer waste can produce value-added products and energy. The refinery waste streams can include, for example, (DSO), fuel coke, and residual oils. The consumer waste can include, for example, waste plastic, waste materials, and waste derivatives. Oxygen that is used in the gasification of the refinery waste and consumer waste can be produced from renewable sources, such as by electrolysis of water, in which the electrolysis is powered by renewable energy, such as solar energy and/or wind energy.

There are number of waste materials including disulfide oil (DSO), fuel coke, and residual oils which are produced in refineries. Some of these waste streams are disposed at a cost, processed within refinery process units, or sold/given away as a commodity product. Plastic derived from fossil fuels also creates a large amount of consumer waste and is a concern worldwide. Conversion of plastic has gained interest in recent years for circular economy. Gasification is a process that converts carbonaceous materials, such as coal, petroleum, biofuel, or biomass with oxygen at high temperature (for example, greater than 800° C.) into syngas, which is a mixture of carbon dioxide, carbon monoxide, and hydrogen. The hydrogen of the syngas produced by gasification can be used in various processes, such as hydroprocessing (hydrotreating and hydrocracking) and hydrogenation (for example, carbon dioxide hydrogenation).

This disclosure also describes hydroprocessing to produce clean fuels and chemicals with a reduced carbon footprint in comparison with conventional hydroprocessing. The hydroprocessing utilizes green hydrogen produced from renewable sources, such as by electrolysis of water, in which the electrolysis is powered by renewable energy, such as solar energy and/or wind energy. The hydroprocessing utilizes heat generated from combustion and the green hydrogen to remove contaminants and crack hydrocarbons in a feed stream. Carbon dioxide, which is produced by the combustion, is captured and converted to useful fuels and/or chemicals. The carbon dioxide can be converted to useful fuels and/or chemicals, for example, by carbon dioxide hydrogenation. The hydrogen used in the carbon dioxide hydrogenation can be supplied by the green hydrogen produced from renewable sources.

The subject matter described in this disclosure can be implemented in particular implementations, so as to realize one or more of the following advantages. Refinery waste streams (such as those including disulfide oil (DSO), fuel coke, and residual oils) and consumer waste plastics can be processed by the described systems and processes to produce useful chemicals, such as methanol, ethanol, or fuel additives (for example, gasoline additives, jet fuel additives, or diesel fuel additives). Thus, waste that is typically disposed of, sold as a low value commodity, or recycled can instead be converted into one or more value added products for integration of a full circle economy. There is a growing interest in the energy transition from fossil fuels to renewable energy and sustainable energy in a global effort to reduce carbon emissions. Some examples of decarbonization pathways in the energy transition to renewable energy include increasing energy efficiency, producing and/or using lower-carbon fuels, and carbon capture and storage (CCS). In efforts to reach carbon neutral processes, hydrogen produced by processes can be labeled as gray hydrogen, blue hydrogen, turquoise hydrogen, cyan hydrogen, or green hydrogen. Gray hydrogen is, for example, produced by steam methane reforming or gasification without carbon capture. Blue hydrogen is, for example, produced by steam methane reforming or gasification with carbon capture (such as 85%-95% carbon capture). Turquoise hydrogen is an emerging technology and is, for example, produced by pyrolysis of methane. Green hydrogen is, for example, produced by electrolysis of water utilizing renewable electricity. Cyan hydrogen is, for example, produced by methods combining those that produce blue hydrogen and green hydrogen. For example, cyan hydrogen is a mixture of blue and green hydrogen. As such, production of gray, blue, turquoise, cyan, or green hydrogen can be considered decarbonization pathways toward a sustainable and reduced carbon economy. The described systems and processes utilize electrical power generated from renewable energy sources, which allow for sustainable practice. The electrical power derived from renewable energy sources is used to generate green hydrogen and oxygen via electrolysis of water. Further, gray or blue hydrogen can be produced by the production of syngas from fuel feedstocks. Any excess hydrogen and/or oxygen produced by the described systems and processes can be, for example, stored for later use, used in a different system or process, or be sold to another user.

FIG. 1A is a schematic diagram of an example system 100 for producing hydrogen from waste products and for producing useful chemicals using the produced hydrogen. The system 100 includes a feed stream 101. The feed stream 101 includes a carbon-based waste material, such as disulfide oil, residual oil, fuel coke, or waste plastic. The system 100 processes the feed stream 101 to produce a product stream 151. The product stream 151 includes a hydrocarbon (such as a light olefin, a heavy olefin, paraffin, or an aromatic), an oxygenate (such as methanol or ethanol), or both.

In some implementations, the feed stream 101 includes a waste stream from a hydrocarbon refinery (such as a crude oil refinery). The feed stream 101 can include at least one of fuel oil, residual oil, tar, or wax from a hydrocarbon refinery. For example, the feed stream 101 includes a mercaptan oxidation (MEROX) waste stream 101*a* that includes disulfide oil. The MEROX waste stream 101*a* can flow, for example, from a MEROX unit 110*a* of a hydrocarbon refinery. The MEROX unit 110*a* can be configured to process liquefied petroleum gas (LPG), naphtha, and kerosene to selectively remove mercaptans. The MEROX unit

110*a* can produce a demercaptanized hydrocarbon stream as a product and disulfide oil as waste (waste stream 101*a*).

For example, the feed stream 101 includes a delayed coking waste stream 101*b* that includes fuel grade coke. The delayed coking waste stream 101*b* can flow, for example, from a delayed coking unit 110*b* of a hydrocarbon refinery. The delayed coking unit 110*b* can be configured to process atmospheric residue, vacuum residue, or both to produce distillate as a product and fuel grade coke as waste (waste stream 101*b*).

For example, the feed stream 101 includes a vacuum distillation waste stream 101*c* that includes vacuum residue. The vacuum distillation waste stream 101*c* can flow, for example, from a vacuum distillation unit 110*c* of a hydrocarbon refinery. The vacuum distillation unit 110*c* can be configured to process atmospheric residue to produce vacuum gas oil as a product and vacuum residue as waste (waste stream 101*c*). Atmospheric residue is the residue resulting from atmospheric distillation.

For example, the feed stream 101 includes a solvent deasphalting waste stream 101*d* that includes asphalt. The solvent deasphalting waste stream 101*d* can flow, for example, from a solvent deasphalting unit (SDU) 110*d* of a hydrocarbon refinery. The SDU 110*d* can be configured to process atmospheric residue, vacuum residue, or both to selectively separate asphalt from oil. The SDU 110*d* can produce deasphalted oil as a product and asphalt as waste (waste stream 101*d*).

For example, the feed stream 101 includes an aromatics recovery waste stream 101*e* that includes aromatics recovery bottoms. The aromatics recovery waste stream 101*e* can flow, for example, from an aromatics recovery unit 110*e* of a hydrocarbon refinery. The aromatics recovery unit 110*e* can be configured to process reformate (high-octane liquid product for high-octane gasoline blends) to extract benzene, toluene, and xylene (BTX) as a product. The resultant bottoms after the BTX has been extracted can be the aromatics recovery waste stream 101*e*. Although shown in FIG. 1A as including waste streams (101*a*, 101*b*, 101*c*, 101*d*, 101*e*, 101*f*) from six sources (110*a*, 110*b*, 110*c*, 110*d*, 110*e*, 110*f*), the feed stream 101 can include waste streams from fewer sources (for example, one source, two sources, three sources, four sources, or five sources) or additional sources (for example, more than six sources).

In some implementations, the feed stream 101 includes consumer waste plastics 101*f*. The consumer waste plastics 101*f* can, for example, be from a consumer plastics waste receptacle or storage unit 110*f*, such as a consumer plastics waste bin (for example, a recycling bin). The consumer waste plastics 101*f* can include typical plastics present in consumer products. For example, the consumer waste plastics 101*f* includes polystyrene, polyphenylene, poly(p-xylene), poly(phenylenevinylene), polybenzyl-type polymer, polyethene, polyethylene terephthalate, polyolefin, polypropylene, polyvinyl chloride, polyamide, polycarbonate, polyurethane, polyester, natural rubber, synthetic rubber, acrylonitrile butadiene styrene, polyethylene/acrylonitrile butadiene styrene, polycarbonate/acrylonitrile butadiene styrene, maleimide/bismaleimide, melamine formaldehyde, phenol formaldehyde, polyepoxide, polyetheretherketone, polyetherimide, polyimide, polylactic acid, polymethyl methacrylate, polytetrafluoroethylene, urea-formaldehyde, diphenylcarbonate, polyether sulfone, polyacrylonitrile, or any combinations of these.

The system 100 includes an electrolysis unit 120, a gasification unit 130, a water-gas shift unit 135, a hydroprocessing unit 140, and a hydrogenation unit 150. Water 121 flows to the electrolysis unit 120. Electrical power 123 is supplied to the electrolysis unit 120. The electrical power 123 supplied to the electrolysis unit 120 is generated from a renewable energy source 160. The electrolysis unit 120 uses the electrical power 123 supplied by the renewable energy source 160 to perform electrolysis on the water 121. Performing electrolysis on the water 121 results in splitting the molecules of the water 121 into hydrogen and oxygen. The electrolysis unit 120 produces a hydrogen stream 125 and an oxygen stream 127. The hydrogen stream 125 includes the hydrogen produced by the electrolysis of the water 121, and the oxygen stream 127 includes the oxygen produced by the electrolysis of the water 121. Some non-limiting examples of suitable renewable energy sources include solar energy, wind energy, tidal energy, hydropower, and geothermal energy. Photovoltaic cells can capture sunlight and convert the captured sunlight into electrical power. Wind can push rotation of turbines, which then convert the rotational energy into electrical power. The natural rise and fall of tides (tidal energy) caused by gravitational interactions between the earth, sun, and moon can be utilized to generate electrical power. The flow of water in bodies of water, such as rivers, streams, and dams, can be utilized to generate electrical power. Geothermal energy is thermal energy available in subterranean locations and can be utilized to generate electrical power. While shown in FIG. 1A as receiving power from the renewable energy source 160, the electrolysis unit 120 can be configured to receive electrical power from various sources. For example, the electrolysis unit 120 can be configured to receive electrical power from a power grid. For example, the electrolysis unit 120 can be configured to receive electrical power from a generator. For example, the electrolysis unit 120 can be configured to receive electrical power from a Rankine cycle. For example, the electrolysis unit 120 can be configured to receive electrical power from a battery or other media that can store and release energy on demand. The electrolysis unit 120 can be configured to switch amongst sources of electrical power based on available power from the various sources and power demand.

The feed stream 101 and a portion 127*a* of the oxygen stream 127 from the electrolysis unit 120 flows to the gasification unit 130. The gasification unit 130 is configured to receive the feed stream 101 and the portion 127*a* of the oxygen stream 127. The gasification unit 130 includes an inlet configured to receive the feed stream 101. In some implementations, the feed stream 101 mixes with the portion 127*a* of the oxygen stream 127 upstream of the gasification unit 130, and the mixture of the feed stream 101 and the portion 127*a* of the oxygen stream 127 flows into the gasification unit 130 via the inlet. In some implementations, the portion 127*a* of the oxygen stream 127 flows into the gasification unit 130 separately from the feed stream 101, for example, via a different inlet of the gasification unit 130. The gasification unit 130 is configured to partially oxidize the feed stream 101 using the portion 127*a* of the oxygen stream 127 to produce a syngas stream 131. The gasification unit 130 includes an outlet configured to discharge the syngas stream 131. In some implementations, the gasification unit 130 includes a gasification reactor that includes a burner (feed injector) for introducing feeds to the gasification process. The syngas stream 131 includes carbon monoxide, carbon dioxide, and hydrogen. In some cases, the syngas stream 131 includes a contaminant, such as hydrogen sulfide ($H_2S$), hydrogen cyanide (HCN), or carbonyl sulfide (OCS). In some cases, the syngas stream 131 includes a hydrocarbon, such as methane. In some implementations, the gasification unit 130 is operated at a gasification operating pressure in a range of from about 2,000 kilopascals (kPa) to about 6,000 kPa. In some implementations, the gasification unit 130 is operated at a gasification operating temperature in a range of from about 800 degrees Celsius (° C.) to about 1,800° C., from about 800° C. to about 1,250° C., from about 800° C. to about 1,100° C., or from about 800° C. to 1,000° C. In some implementations, an oxygen-to-carbon molar ratio of the portion 127*a* of the oxygen stream 127 entering the gasification unit 130 in relation to the feed stream 101 entering the gasification unit 130 in a range of from about 1:25 to about 2:1. In some implementations, the gasifier of the gasification unit 130 includes a gasification catalyst. In some implementations, the syngas stream 131 has a hydrogen-to-carbon monoxide molar ratio in a range of from about 0.85:1 to about 1.2:1.

In some implementations, steam is provided to the gasification unit 130. The rate of the oxygen (from the portion 127*a* of the oxygen stream 127) and/or steam provided to the gasification unit 130 can be controlled in a manner to carry out gasification of the feed stream 101 to produce the syngas stream 131. In some implementations, the steam mixes with the portion 127*a* of the oxygen stream 127 upstream of the gasification unit 130, and the mixture of the steam and the portion 127*a* of the oxygen stream 127 flows into the gasification unit 130 via the same inlet. In some implementations, the steam flows into the gasification unit 130 separately from the portion 127*a* of the oxygen stream 127, for example, via a different inlet of the gasification unit 130. In some implementations, a steam-to-carbon weight ratio of the steam entering the gasification unit 130 in relation to the feed stream 101 entering the gasification unit 130 is in a range of from about 1:100 to about 10:1.

The syngas stream 131 flows from the gasification unit 130 to the water-gas shift unit 135. The water-gas shift unit 135 includes an inlet configured to receive the syngas stream 131 from the gasification unit 130. The water-gas shift unit 135 is configured to react at least a portion of the carbon monoxide of the syngas stream 131 with water 133 (for example, in the form of steam) to produce additional carbon dioxide and hydrogen, thereby producing a shifted syngas stream 137. The water-gas shift unit 135 can, for example, include a water-gas shift reactor and a water-gas shift catalyst that accelerates the rate of conversion of carbon monoxide into carbon dioxide for producing the shifted syngas stream 137. The water-gas shift catalyst can include alkali oxides, such as a bimetallic cobalt-molybdenum (Co—Mo) catalyst supported by aluminum oxide ($Al_2O_3$) for enhanced water capturing ability. For example, the water-gas shift catalyst includes from about 5% to about 10% molybdenum, up to about 5% cobalt, from about 1% to about 25% alkali metals (such as sodium, potassium, calcium, or magnesium) with the balance of aluminum oxide ($Al_2O_3$). The water-gas shift catalyst can include iron oxide, chromium oxide, magnesium oxide, copper oxide, zinc oxide, aluminum oxide, or any combinations of these. The equilibrium reaction shown in Equation 1 occurs within the water-gas shift unit 135.

$$CO + H_2O \leftrightarrow CO_2 + H_2 \quad (1)$$

The water-gas shift unit 135 includes an outlet configured to discharge the shifted syngas 137. The shifted syngas stream 137 exiting the water-gas shift unit 135 has a greater hydrogen content in comparison with the syngas stream 131 entering the water-gas shift unit 135. In comparison with the syngas stream 131 entering the water-gas shift unit 135, the shifted syngas stream 137 exiting the water-gas shift unit 135 has a greater hydrogen gas content, a greater carbon dioxide content, a lesser carbon monoxide content, and a lesser water content.

At least a portion of the shifted syngas stream 137 flows from the water-gas shift unit 135 to the hydroprocessing unit 140. For example, hydrogen 137*a* of the shifted syngas stream 137 flows to the hydroprocessing unit 140. The hydroprocessing unit 140 includes an inlet configured to receive a hydrocarbon feed stream 141 which includes a hydrocarbon. The hydrocarbon feed stream 141 can include, for example, an atmospheric distillate, a vacuum distillate, or both. Atmospheric distillate can be the distillate obtained from atmospheric distillation at a crude oil refinery. Vacuum distillate can be the distillate obtained from vacuum distillation at a crude oil refinery. The hydroprocessing unit 140 can be configured to receive the portion 125*a* of the hydrogen stream 125 produced by the electrolysis unit 120. In some implementations, the hydrogen 137*a* of the shifted syngas stream 137 mixes with a portion 125*a* of the hydrogen stream 125 upstream of the hydroprocessing unit 140, and the mixture of the hydrogen 137*a* of the shifted syngas stream 137 and the portion 125*a* of the hydrogen stream 125 flows into the hydroprocessing unit 140 via the inlet. In some implementations, the portion 125*a* of the hydrogen stream 125 flows into the hydroprocessing unit 140 separately from the hydrogen 137*a* of the shifted syngas stream 137, for example, via a different inlet of the hydroprocessing unit 140. The hydroprocessing unit 140 is configured to react the hydrocarbon feed stream 141 with the hydrogen 137*a* of the shifted syngas stream 137 and the portion 125*a* of the hydrogen stream 125 to remove non-carbon impurities from the hydrocarbon feed stream 141 and break carbon-carbon bonds in the hydrocarbon feed stream 141, thereby producing a hydroprocessing product stream 143 comprising a saturated hydrocarbon. A saturated hydrocarbon is a hydrocarbon that is fully saturated with hydrogen.

The hydroprocessing unit 140 can, for example, include a hydrotreater including a hydrotreating catalyst that accelerates the rate of reactions involving removing sulfur from carbon-containing compounds. The hydrotreating catalyst can include, for example, an alumina base impregnated with cobalt, molybdenum, nickel, or any combinations of these. The hydroprocessing unit 140 can, for example, include a hydrocracker including a hydrocracking catalyst that accelerates the rate of reactions that break carbon-carbon bonds. The hydrocracking catalyst can include, for example, a metal (such as iron, cobalt, nickel, ruthenium, rhodium, palladium, osmium, iridium, platinum, molybdenum, tungsten, or any combinations of these) and a support (such as an alumina, zeolite, clay, or any combinations of these). In some implementations, the hydroprocessing unit 140 is configured to operate at a hydroprocessing operating temperature in a range of from about 150° C. to about 450° C. and a hydroprocessing operating pressure in a range of from about 2,000 kPa to about 20,000 kPa. Each of the hydrotreater and the hydrocracker of the hydroprocessing unit 140 can, for example, include any of a fixed bed reactor, an ebullated bed reactor, a moving bed reactor, or a slurry bed reactor.

At least a portion of the shifted syngas stream 137 flows from the water-gas shift unit 135 to the hydrogenation reactor 150. For example, carbon dioxide 137*b* of the shifted syngas stream 137 flows to the hydrogenation reactor 150. The hydrogenation reactor 150 includes an inlet configured to receive the carbon dioxide 137*b* of the shifted syngas stream 137. The hydrogenation reactor 150 is configured to receive a second portion 125*b* of the hydrogen stream 125. In some implementations, the carbon dioxide 137*b* of the shifted syngas stream 137 mixes with the portion 125*b* of the hydrogen stream 125 upstream of the hydrogenation reactor 150, and the mixture of the carbon dioxide 137*b* of the shifted syngas stream 137 and the portion 125*b* of the hydrogen stream 125 flows into the hydrogenation reactor 150 via the inlet. In some implementations, the portion 125*b* of the hydrogen stream 125 flows into the hydrogenation reactor 150 separately from the carbon dioxide 137*b* of the shifted syngas stream 137, for example, via a different inlet of the hydrogenation reactor 150. The hydrogenation reactor 150 is configured to hydrogenate the carbon dioxide 137*b* of the shifted syngas stream 137 using the portion 125*b* of the hydrogen stream 125, thereby producing the product stream 151. The hydroprocessing unit 140 can include a furnace that combusts fuel to provide heat for maintaining operating conditions in the hydrotreater and/or hydrocracker. In some implementations, the carbon dioxide that is produced by combustion of the fuel by the furnace of the hydroprocessing unit 140 can be flowed to the hydrogenation reactor 150 to be converted into useful chemicals, such as methanol, ethanol, fuels, and fuel additives, and increase the amount of the product stream 151 produced by the hydrogenation reactor 150.

The hydrogenation reactor 150 can, for example, include a fixed bed reactor. The hydrogenation reactor 150 can include a hydrogenation catalyst that accelerates the rate of reaction between carbon dioxide and hydrogen, reaction between carbon monoxide and hydrogen, or both. The hydrogenation catalyst can include, for example, copper, zinc, chromium, alumina, or any combinations of these. The hydrogenation reactor 150 can be configured to hydrogenate the carbon dioxide 137*b* of the shifted syngas stream 137 at a hydrogenation operating temperature in a range of from about 150° C. to about 450° C. and a hydrogenation operating pressure in a range of from about 200 kPa to about 6,000 kPa. In some implementations, a hydrogen-to-carbon dioxide molar ratio of the second portion 125*b* of the hydrogen stream 125 and the carbon dioxide 137*b* of the shifted syngas stream 137 entering the hydrogenation reactor 150 is in a range of from about 2:1 to about 10:1. In some implementations, the hydrogenation reactor 150 is configured to process the second portion 125*b* of the hydrogen stream 125 and the carbon dioxide 137*b* of the shifted syngas stream 137 at a gas hourly space velocity in a range of from about 5,000 per hour ($h^{-1}$) to about 30,000 $h^{-1}$. The second portion 125*b* of the hydrogen stream 125 and the carbon dioxide 137*b* of the shifted syngas stream 137 can have a gas hourly space velocity in a range of from about 5,000 $h^{-1}$ to about 30,000 $h^{-1}$ in the hydrogenation reactor 150. The carbon dioxide 137*b* of the shifted syngas stream 137 is not released to the atmosphere and therefore does not contribute to greenhouse gas emissions. The carbon dioxide 137*b* of the shifted syngas stream 137 is instead converted by the hydrogenation reactor 150 into useful products (product stream 151), such as methanol, ethanol, fuels, and fuel additives.

The hydrogen 137*a* of the shifted syngas stream 137 and the carbon dioxide 137*b* of the shifted syngas stream 137 can be separated prior to flowing to the hydroprocessing unit 140 and the hydrogenation reactor 150, respectively. For example, the system 100 can include a separation unit that is downstream of the water-gas shift unit 135 and upstream of the hydroprocessing unit 140 and hydrogenation reactor 150. The separation unit can include, for example, solvent absorber columns for selective absorption of hydrogen sulfide ($H_2S$) and carbon dioxide, combined membrane and pressure swing adsorption for separation of carbon monoxide and hydrogen, and regeneration of solvent. In some implementations, the integration of the water-gas shift unit 135, separation unit, and pressure swing adsorption can separate the shifted syngas stream 137 into a high purity carbon dioxide stream (carbon dioxide 137*b*), a high purity carbon monoxide stream, and a high purity hydrogen stream (hydrogen 137*a*).

A remaining portion of the hydrogen stream 125 can be stored and/or transported for use in another industrial process, such as ammonia production, power generation, feedstock for hydrogen fuel cells, hydrocarbon sweetening processes, petroleum refining, metal treating (for example, steel production), fertilizer production, and food processing. A remaining portion of the oxygen stream 127 can be stored and/or transported for use in another industrial process.

Figure 1B:
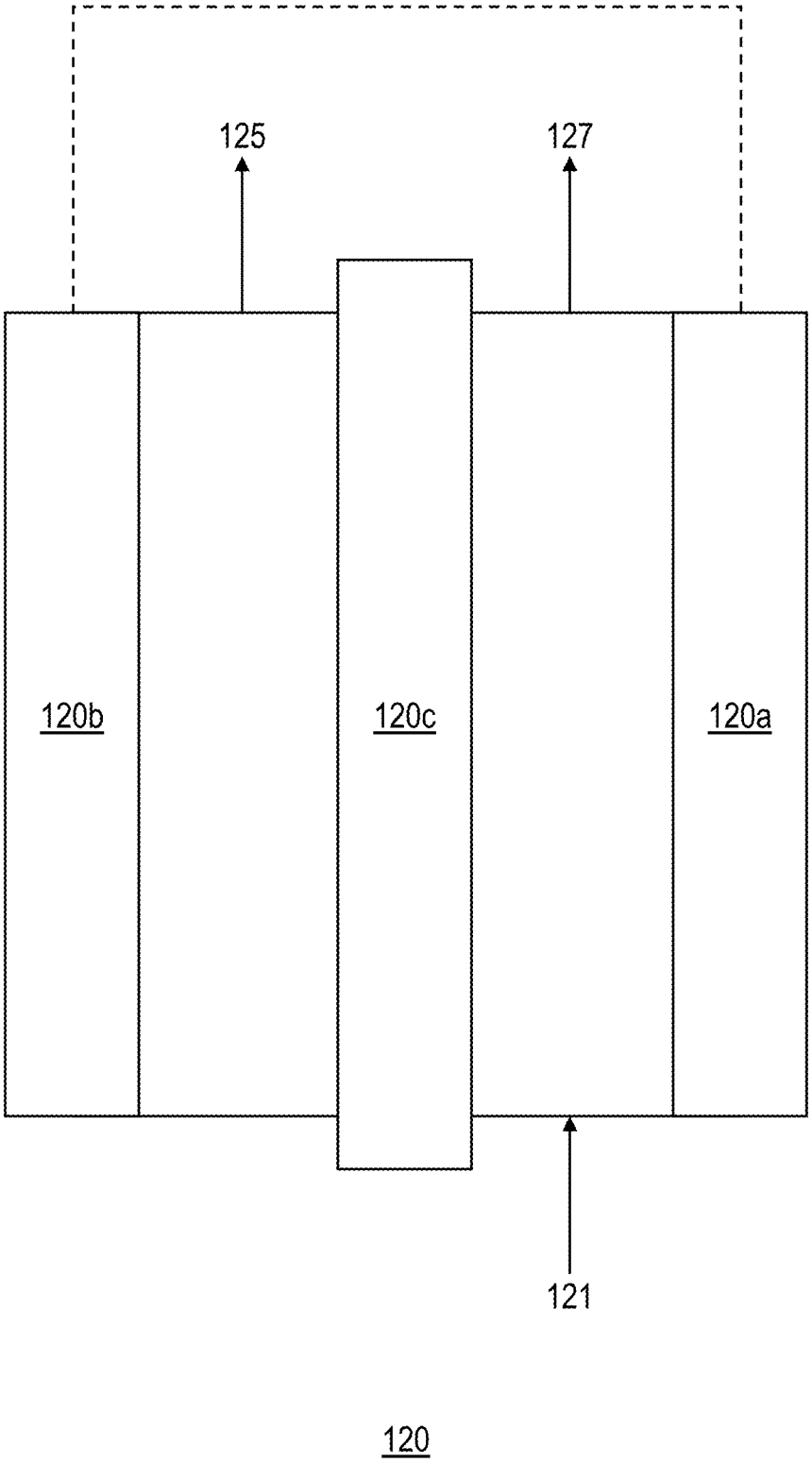
FIG. 1B is a schematic diagram of an example electrolysis unit that can be implemented in the system of FIG. 1A.

FIG. 1B is a schematic diagram of an example of the electrolysis unit 120. The example electrolysis unit 120 shown in FIG. 1B is a polymer electrolyte membrane (PEM) electrolyzer, but different types of electrolyzers, such as an alkaline water electrolyzer, a solid oxide electrolyzer, or an anion exchange membrane (AEM) electrolyzer, may alternatively or additionally be used. The electrolysis unit 120 includes an anode 120*a*, a cathode 120*b*, and a proton-exchange membrane 120*c*. The proton-exchange membrane 120*c* is a solid polymer electrolyte membrane that conducts protons from the anode 120*a* to the cathode 120*b* while insulating the electrodes (120*a*, 120*b*) electrically. The half reaction taking place on the side of the anode 120*a* is also referred to as the oxygen evolution reaction (Equation 2).

$$2H_2O \rightarrow O_2 + 4H^+ + 4e^- \quad (2)$$

The half reaction taking place on the side of the cathode 120*b* is also referred to as the hydrogen evolution reaction (Equation 3).

$$4H^+ + 4e^- \rightarrow 2H_2 \quad (3)$$

The water 121 enters the electrolysis unit 120. The electrolysis unit 120 splits the water into hydrogen and oxygen. The generated hydrogen and oxygen are separated from each other. For example, the membrane may be permeable to hydrogen, such that the hydrogen is allowed to pass through the membrane to separate from the oxygen, while the oxygen remains on the opposite side of the membrane. The oxygen stream 127 exits the electrolysis unit 120 from the side of the anode 120*a*, and the hydrogen stream 125 exits the electrolysis unit 120 from the side of the cathode 120*b*.

The open circuit voltage of the operating electrolysis unit 120 can be in a range of from about 1.2 volts (V) to about 2.5 V. In some implementations, the operating temperature of the electrolysis unit 120 is in a range of from about 50 degrees Celsius (° C.) to about 80° C. In some implementations, the operating pressure of the electrolysis unit 120 is less than about 70 bar. In some implementations, the electric current density of the power provided to the electrolysis unit 120 is in a range of from about 1 amperes per square centimeter ($A/cm^2$) to about 6 $A/cm^2$.

In cases in which the electrolysis unit 120 is an alkaline water electrolysis unit, the open circuit voltage of the operating electrolysis unit 120 can be in a range of from about 1.2 V to about 3 V. In some implementations, the operating temperature of the electrolysis unit 120 is in a range of from about 70° C. to about 90° C. In some implementations, the operating pressure of the electrolysis unit 120 is less than about 70 bar. In some implementations, the electric current density of the power provided to the electrolysis unit 120 is in a range of from about 0.2 $A/cm^2$ to about 6 $A/cm^2$.

In cases in which the electrolysis unit 120 is a solid oxide electrolysis unit, the open circuit voltage of the operating electrolysis unit 120 can be in a range of from about 1 V to about 1.5 V. In some implementations, the operating temperature of the electrolysis unit 120 is in a range of from about 700° C. to about 850° C. In some implementations, the operating pressure of the electrolysis unit 120 is less than about 30 bar. In some implementations, the electric current density of the power provided to the electrolysis unit 120 is in a range of from about 0.3 $A/cm^2$ to about 6 $A/cm^2$.

In cases in which the electrolysis unit 120 is an AEM electrolysis unit, the open circuit voltage of the operating electrolysis unit 120 can be in a range of from about 1.2 V to about 2 V. In some implementations, the operating temperature of the electrolysis unit 120 is in a range of from about 40° C. to about 80° C. In some implementations, the operating pressure of the electrolysis unit 120 is less than about 70 bar. In some implementations, the electric current density of the power provided to the electrolysis unit 120 is in a range of from about 0.2 $A/cm^2$ to about 6 $A/cm^2$.

Figure 2:
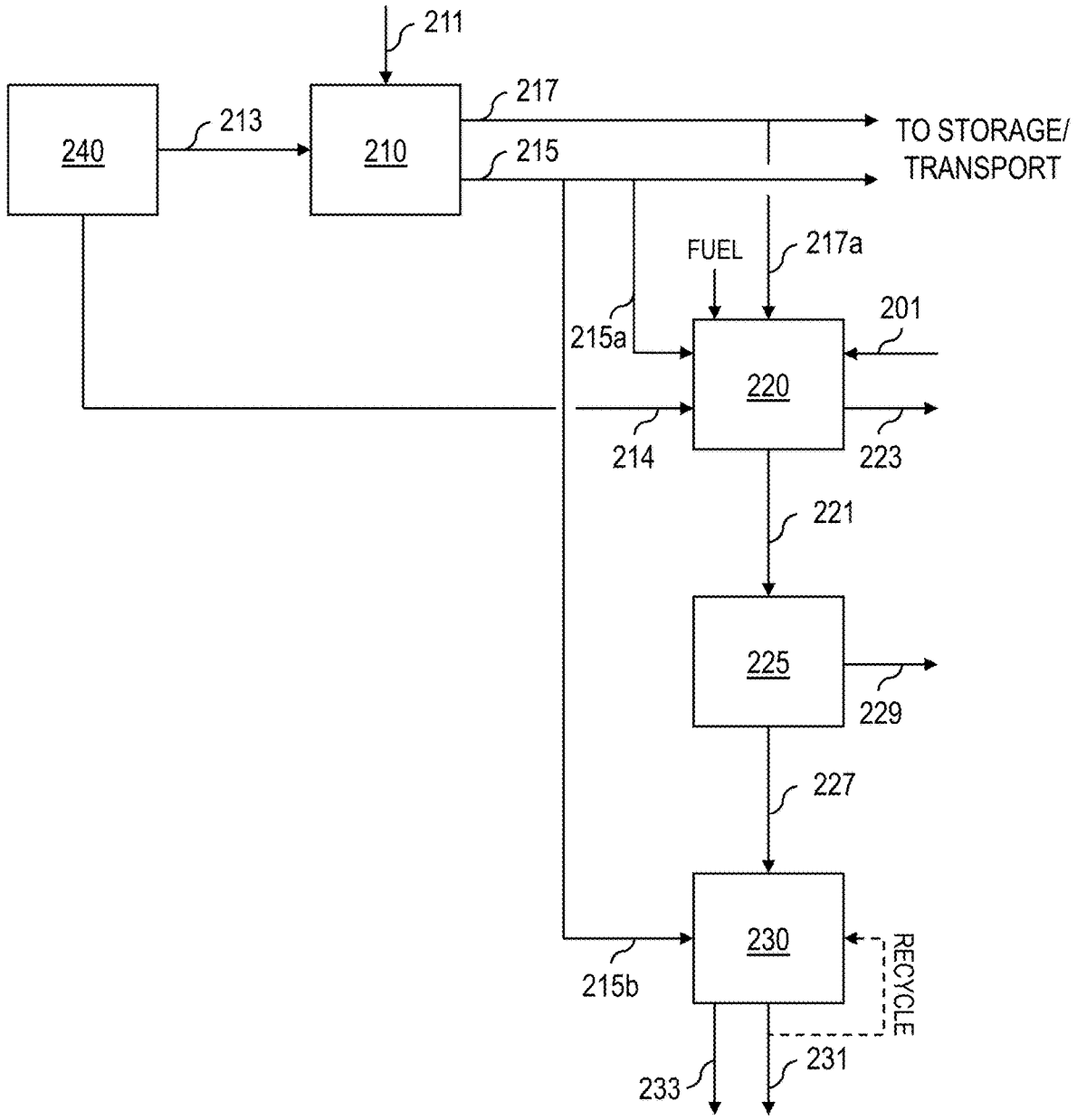
FIG. 2 is a schematic diagram of an example system that includes hydroprocessing for producing clean fuels and chemicals with a reduced carbon footprint.

FIG. 2 is a schematic diagram of an example system 200 that includes hydroprocessing for producing clean fuels and chemicals with a reduced carbon footprint. The system 200 includes a feed stream 201. The feed stream 201 includes a hydrocarbon oil. The feed stream 201 can include, for example, synthetic crude oil, bitumen, oil sand, shell oil, coal liquid, vacuum gas oil, deasphalted oil, light coker gas oil, heavy coker gas oil, cycle oil from fluid catalytic cracking, gas oil from visbreaking, distillate, naphtha, bridged diaromatic molecules, or any combinations of these. The system 200 processes the feed stream 201 to produce a product stream 231. The product stream 231 includes a hydrocarbon (such as a light olefin, a heavy olefin, paraffin, or an aromatic), an oxygenate (such as methanol or ethanol), or both.

The system 200 includes an electrolysis unit 210, a hydroprocessing unit 220, and a hydrogenation unit 230. Water 211 flows to the electrolysis unit 210. Electrical power 213 is supplied to the electrolysis unit 210. The electrical power 213 supplied to the electrolysis unit 210 is generated from a renewable energy source 240. The electrolysis unit 210 uses the electrical power 213 supplied by the renewable energy source 240 to perform electrolysis on the water 211. Performing electrolysis on the water 211 results in splitting the molecules of the water 211 into hydrogen and oxygen. The electrolysis unit 210 produces a hydrogen stream 215 and an oxygen stream 217. The hydrogen stream 215 includes the hydrogen produced by the electrolysis of the water 211, and the oxygen stream 217 includes the oxygen produced by the electrolysis of the water 211. While shown in FIG. 2 as receiving power from the renewable energy source 240, the electrolysis unit 210 can be configured to receive electrical power from various sources. For example, the electrolysis unit 210 can be configured to receive electrical power from a power grid. For example, the electrolysis unit 210 can be configured to receive electrical power from a generator. For example, the electrolysis unit 210 can be configured to receive electrical power from a Rankine cycle. For example, the electrolysis unit 210 can be configured to receive electrical power from a battery or other media that can store and release energy on demand. The electrolysis unit 210 can be configured to switch amongst sources of electrical power based on available power from the various sources and power demand. The electrolysis unit 210 can, for example, be similar to or the same as the example electrolysis unit 120 shown in FIG. 1B.

A portion 217*a* of the oxygen stream 217 from the electrolysis unit 210 flows to the hydroprocessing unit 220. The hydroprocessing unit 220 includes an inlet configured to receive the portion 217*a* of the oxygen stream 217. The hydroprocessing unit 220 is configured to receive a fuel, such as methane. In some implementations, the fuel mixes with the portion 217*a* of the oxygen stream 217 upstream of the hydroprocessing unit 220, and the mixture of the fuel and the portion 217*a* of the oxygen stream 217 flows into the hydroprocessing unit 220 via the inlet. In some implementations, the fuel flows into the hydroprocessing unit 220 separately from the portion 217*a* of the oxygen stream 217, for example, via a different inlet of the hydroprocessing unit 220. The hydroprocessing unit 220 is configured to combust the fuel using at least the portion 217*a* of the oxygen stream 217 to produce heat and a flue gas 221 that includes carbon dioxide.

The feed stream 201 and a portion 215*a* of the hydrogen stream 215 from the electrolysis unit 210 flows to the hydroprocessing unit 220. The hydroprocessing unit 220 includes an inlet configured to receive the feed stream 201. In some implementations, the feed stream 201 mixes with the portion 215*a* of the hydrogen stream 215 upstream of the hydroprocessing unit 220, and the mixture of the feed stream 201 and the portion 215*a* of the hydrogen stream 215 flows into the hydroprocessing unit 220 via the inlet. In some implementations, the portion 215*a* of the hydrogen stream 215 flows into the hydroprocessing unit 220 separately from feed stream 201, for example, via a different inlet of the hydroprocessing unit 220. The hydroprocessing unit 220 is configured to react the feed stream 201 with the portion 215*a* of the hydrogen stream 215 to remove non-carbon impurities from the feed stream 201 and break carbon-carbon bonds in the feed stream 201, thereby producing a hydroprocessing product stream 223 that includes a saturated hydrocarbon.

The hydroprocessing unit 220 can, for example, include a hydrotreater including a hydrotreating catalyst that accelerates the rate of reactions involving removing sulfur from carbon-containing compounds. The hydrotreating catalyst can include, for example, an alumina base impregnated with cobalt, molybdenum, nickel, or any combinations of these. The hydroprocessing unit 220 can, for example, include a hydrocracker including a hydrocracking catalyst that accelerates the rate of reactions that break carbon-carbon bonds. The hydrocracking catalyst can include, for example, a metal (such as iron, cobalt, nickel, ruthenium, rhodium, palladium, osmium, iridium, platinum, molybdenum, tungsten, or any combinations of these) and a support (such as an alumina, zeolite, clay, or any combinations of these). In some implementations, the hydroprocessing unit 220 is configured to operate at a hydroprocessing operating temperature in a range of from about 150° C. to about 450° C. and a hydroprocessing operating pressure in a range of from about 2,000 kPa to about 20,000 kPa. Each of the hydrotreater and the hydrocracker of the hydroprocessing unit 220 can, for example, include any of a fixed bed reactor, an ebullated bed reactor, a moving bed reactor, or a slurry bed reactor. In some implementations, the hydroprocessing unit 220 receives electrical power 214 from the renewable energy source 240.

In some implementations, the feed stream 201 entering the hydrotreater of the hydroprocessing unit 220 has a density of about 0.925 grams per cubic centimeter. In some implementations, the feed stream 201 entering the hydrotreater of the hydroprocessing unit 220 includes about 2.9 wt. % sulfur. In some implementations, the feed stream 201 entering the hydrotreater of the hydroprocessing unit 220 includes about 820 parts per million (ppm) of nitrogen. In some implementations, the feed stream 201 entering the hydrotreater of the hydroprocessing unit 220 includes about 89 wt. % of components with boiling points greater than about 360° C. In some implementations, the feed stream 201 entering the hydrotreater of the hydroprocessing unit 220 includes about 11 wt. % of components with boiling points in a range of from about 260° C. to about 360° C. In some implementations, the hydroprocessing product stream 223 exiting the hydrocracker of the hydroprocessing unit 220 includes about 1.3 wt. % gas (C1-C4). In some implementations, the hydroprocessing product stream 223 exiting the hydrocracker of the hydroprocessing unit 220 includes about 5.6 wt. % naphtha (for example, hydrocarbon components with boiling points in a range of from about 36° C. to about 145° C. or from about 50° C. to about 145° C.). In some implementations, the hydroprocessing product stream 223 exiting the hydrocracker of the hydroprocessing unit 220 includes about 26 wt. % kerosene (with boiling points in a range of from about 145° C. to about 260° C.). In some implementations, the hydroprocessing product stream 223 exiting the hydrocracker of the hydroprocessing unit 220 includes about 24.1 wt. % gasoil (with boiling points in a range of from about 260° C. to about 360° C.). In some implementations, the hydroprocessing product stream 223 exiting the hydrocracker of the hydroprocessing unit 220 includes about 50.1 wt. % middle distillate (with boiling points in a range of from about 145° C. to 360° C.). In some implementations, the hydroprocessing product stream 223 exiting the hydrocracker of the hydroprocessing unit 220 includes about 42.9 wt. % bottoms (with boiling points greater than about 360° C.).

At least a portion of the flue gas 221 flows from the hydroprocessing unit 220 to the hydrogenation reactor 230. In some implementations, the system 200 includes a separation unit 225 that is downstream of the hydroprocessing unit 220 and upstream of the hydrogenation reactor 230. The separation unit 225 can include, for example, solvent absorber columns for selective absorption of hydrogen sulfide ($H_2S$) and carbon dioxide. In some implementations, the separation unit 225 includes pressure swing adsorption for separating the flue gas 221 into a high purity carbon dioxide stream 227 and a waste stream 229. The waste stream 229 can include, for example, hydrogen sulfide, hydrocarbons, and ammonia which have been separated from the flue gas 221 by the separation unit 225.

The carbon dioxide stream 227 (which is a portion of the flue gas 221) can flow from the separation unit 225 to the hydrogenation reactor 230. The hydrogenation reactor 230 includes an inlet configured to receive the carbon dioxide stream 227. The hydrogenation reactor 230 is configured to receive a second portion 215*b* of the hydrogen stream 215 generated by the electrolysis unit 210. In some implementations, the carbon dioxide stream 227 mixes with the portion 215*b* of the hydrogen stream 215 upstream of the hydrogenation reactor 230, and the mixture of the carbon dioxide stream 227 and the portion 215*b* of the hydrogen stream 215 flows into the hydrogenation reactor 230 via the inlet. In some implementations, the portion 215*b* of the hydrogen stream 215 flows into the hydrogenation reactor 230 separately from the carbon dioxide stream 227, for example, via a different inlet of the hydrogenation reactor 230. The hydrogenation reactor 230 is configured to hydrogenate the carbon dioxide stream 227 using the portion 215*b* of the hydrogen stream 215, thereby producing the product stream 231. Unreacted components (such as unreacted carbon dioxide and unreacted hydrogen) can be recycled to the hydrogenation reactor 230 to achieve increased overall conversion (in some cases, full conversion).

The hydrogenation reactor 230 can, for example, include a fixed bed reactor. The hydrogenation reactor 230 can include a hydrogenation catalyst that accelerates the rate of reaction between carbon dioxide and hydrogen, reaction between carbon monoxide and hydrogen, or both. The hydrogenation catalyst can include, for example, copper, zinc, chromium, alumina, or any combinations of these. The hydrogenation reactor 230 can be configured to hydrogenate the carbon dioxide stream 227 at a hydrogenation operating temperature in a range of from about 150° C. to about 450° C. and a hydrogenation operating pressure in a range of from about 200 kPa to about 6,000 kPa. In some implementations, a hydrogen-to-carbon dioxide molar ratio of the second portion 215*b* of the hydrogen stream 215 and the carbon dioxide stream 227 entering the hydrogenation reactor 230 is in a range of from about 2:1 to about 10:1. In some implementations, the hydrogenation reactor 230 is configured to process the second portion 215*b* of the hydrogen stream 215 and the carbon dioxide stream 227 at a gas hourly space velocity in a range of from about 5,000 per hour ($h^{-1}$) to about 30,000 $h^{-1}$. The second portion 215*b* of the hydrogen stream 215 and the carbon dioxide stream 227 can have a gas hourly space velocity in a range of from about 5,000 $h^{-1}$ to about 30,000 $h^{-1}$ in the hydrogenation reactor 230. The carbon dioxide stream 227 is not released to the atmosphere and therefore does not contribute to greenhouse gas emissions. The carbon dioxide stream 227 is instead converted by the hydrogenation reactor 230 into useful products (product stream 231), such as methanol, ethanol, fuels, and fuel additives. In some implementations, a contaminants stream 233 is removed from the hydrogenation reactor 230. The contaminants stream 233 can include, for example, water and other impurities.

A remaining portion of the hydrogen stream 215 can be stored and/or transported for use in another industrial process, such as ammonia production, power generation, feedstock for hydrogen fuel cells, hydrocarbon sweetening processes, petroleum refining, metal treating (for example, steel production), fertilizer production, and food processing. A remaining portion of the oxygen stream 217 can be stored and/or transported for use in another industrial process.

In each of the configurations described with respect to the system 100 (shown in FIG. 1A) and its subsystems (such as the electrolysis unit 120, the gasification unit 130, the water-gas shift unit 135, the hydroprocessing unit 140, and the hydrogenation reactor 150), process streams (also referred to as "streams") are flowed within each subsystem of the system 100 and between subsystems of the system 100. The process streams can be flowed using one or more flow control systems implemented throughout the system 100 (and/or its subsystems). A flow control system can include one or more flow pumps to pump the process streams (such as the water 121), one or more compressors to pressurize the process streams, one or more flow pipes through which the process streams are flowed, and one or more valves to regulate the flow of streams through the pipes. Such flow control systems can be implemented similarly in the system 200 shown in FIG. 2.

In some implementations, a flow control system can be operated manually. For example, an operator can set a flow rate for each pump and/or compressor by changing the position of a valve (open, partially open, or closed) to regulate the flow of the process streams through the pipes in the flow control system. Once the operator has set the flow rates and the valve positions for all flow control systems distributed across the system 100 (and/or its subsystems), the flow control system can flow the streams within a unit or between units under constant flow conditions, for example, constant volumetric or mass flow rates. To change the flow conditions, the operator can manually operate the flow control system, for example, by changing the valve position.

In some implementations, a flow control system can be operated automatically. For example, the flow control system can be connected to a computer system to operate the flow control system. The computer system can include a computer-readable medium storing instructions (such as flow control instructions) executable by one or more processors to perform operations (such as flow control operations). For example, an operator can set the flow rates by setting the valve positions for all flow control systems distributed across the system 100 (and/or its subsystems) using the computer system. In such implementations, the operator can manually change the flow conditions by providing inputs through the computer system. In such implementations, the computer system can automatically (that is, without manual intervention) control one or more of the flow control systems, for example, using feedback systems implemented in one or more units and connected to the computer system. For example, a sensor (such as a pressure sensor or temperature sensor) can be connected to a pipe through which a process stream flows. The sensor can monitor and provide a flow conditions (such as a pressure or temperature) of the process stream to the computer system. In response to the flow condition deviating from a set point (such as a target pressure value or target temperature value) or exceeding a threshold (such as a threshold pressure value or threshold temperature value), the computer system can automatically perform operations. For example, if the pressure or temperature in the pipe exceeds the threshold pressure value or the threshold temperature value, respectively, the computer system can provide a signal to open a valve to relieve pressure or a signal to shut down process stream flow. As another example, the computer system can operate the flow control system based on measured flows, compositions, operating conditions, or any combinations of these of one or more of the process streams (for example, the feed stream 101 or the product stream 151). An analyzer can, for example, detect fluctuations in properties and/or conditions of a process stream, and the computer system can adjust a flow of the flow control system based on the detected fluctuations to maintain a desired specification and/or parameter of the process stream.

Figure 3:
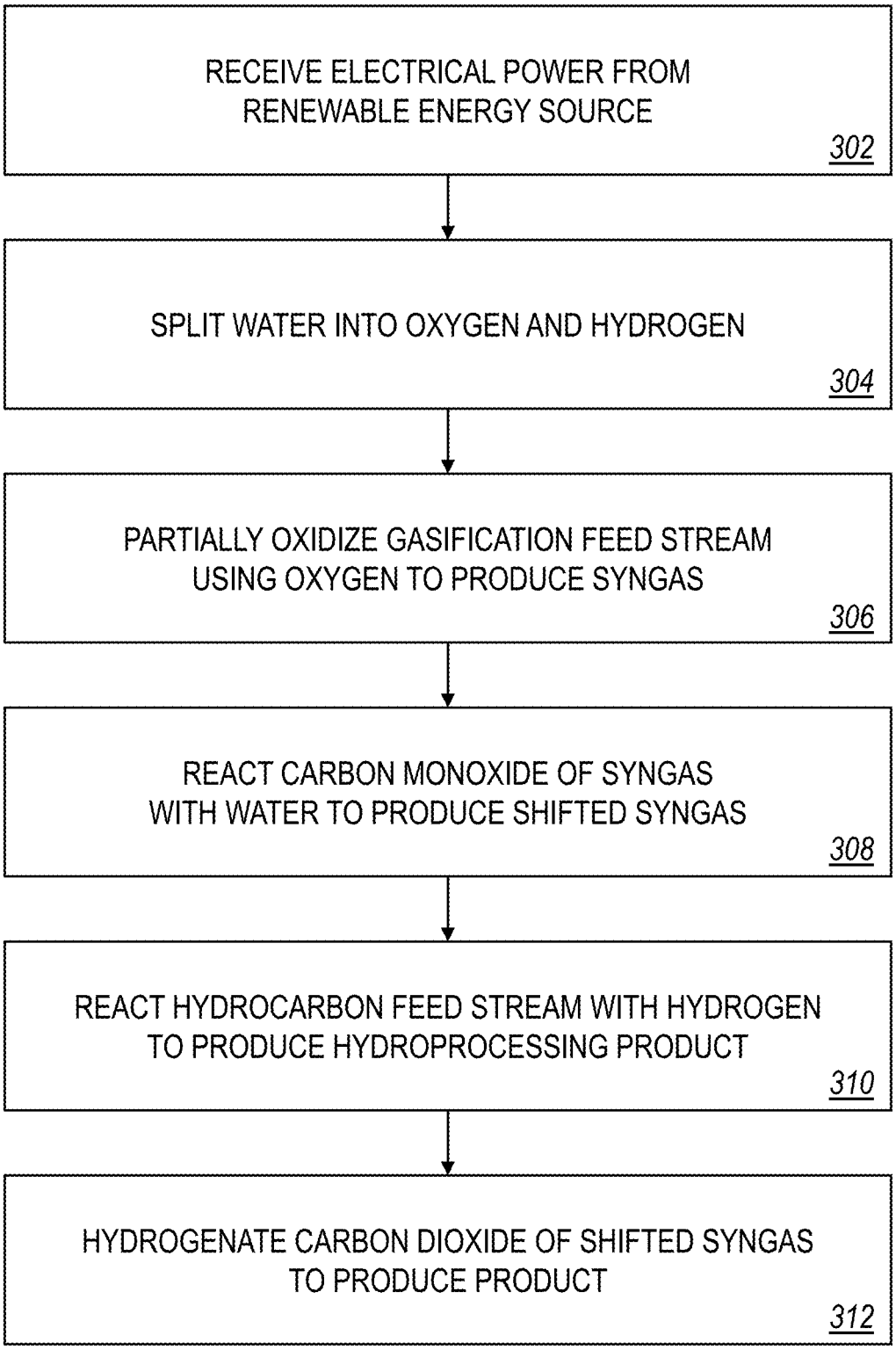
FIG. 3 is a flow chart of an example method for producing hydrogen from waste products and for producing useful chemicals using the produced hydrogen.

FIG. 3 is a flow chart of an example method 300 for producing hydrogen from waste products and for producing useful chemicals using the produced hydrogen. The system 100 can, for example, implement the method 300. At block 302, an electrolysis unit (such as the electrolysis unit 120) receives electrical power (such as the electrical power 123) derived from a renewable energy source (such as the renewable energy source 160). At block 304, the electrolysis unit 120 splits water (such as the water 121) into oxygen and hydrogen using the received electrical power (block 302) to produce an oxygen stream (such as the oxygen stream 127) and a hydrogen stream (such as the hydrogen stream 125). The oxygen stream 127 includes the oxygen produced by the electrolysis unit 120. The hydrogen stream 125 includes the hydrogen produced by the electrolysis unit 120. At block 306, a gasification unit (such as the gasification unit 130) partially oxidizes a gasification feed stream (such as the feed stream 101) using at least a portion (such as the portion 127*a*) of the oxygen stream 127 to produce a syngas stream (such as the syngas stream 131). The syngas stream 131 includes carbon dioxide, carbon monoxide, and hydrogen. The feed stream 101 includes consumer waste plastics (such as the consumer waste plastics 101*f*) and a waste stream from a hydrocarbon refinery (such as at least one of the MEROX waste stream 101*a*, the delayed coking waste stream 101*b*, the vacuum distillation waste stream 101*c*, the solvent deasphalting waste stream 101*d*, or the aromatics recovery waste stream 101*e*). At block 308, a water-gas shift unit (such as the water-gas shift unit 135) reacts at least a portion of the carbon monoxide of the syngas stream 131 with water (such as the steam 133) to produce additional carbon dioxide and hydrogen. Reacting at least the portion of the carbon monoxide of the syngas stream 131 with water 133 at block 308 produces a shifted syngas stream (such as the shifted syngas stream 137). The shifted syngas stream 137 produced at block 308 has a greater hydrogen content in comparison with the syngas stream 131 produced at block 306. At block 310, a hydroprocessing unit (such as the hydroprocessing unit 140) reacts a hydrocarbon feed stream (such as the hydrocarbon feed stream 141) with at least a portion of the hydrogen (such as the hydrogen 137*a*) of the shifted syngas stream 137 and a first portion (such as the portion 125*a*) of the hydrogen stream 125 produced by the electrolysis unit 120 (block 304) to remove non-carbon impurities from the hydrocarbon feed stream 141 and break carbon-carbon bonds in the hydrocarbon feed stream 141. Reacting the hydrocarbon feed stream 141 with at least the portion of the hydrogen 137*a* of the shifted syngas stream 137 and the portion 125*a* of the hydrogen stream 125 at block 310 produces a hydroprocessing product stream (such as the hydroprocessing product stream 143). The hydroprocessing product stream 143 produced at block 310 includes a saturated hydrocarbon. At block 312, a hydrogenation reactor (such as the hydrogenation reactor 150) hydrogenates at least a portion of the carbon dioxide (such as the carbon dioxide 137*b*) of the shifted syngas stream 137 using a second portion (such as the portion 125*b*) of the hydrogen stream 125 produced by the electrolysis unit 120 (block 304) to produce a product stream (such as the product stream 151). The product stream 151 produced at block 312 includes a hydrocarbon, an oxygenate, or both.

Figure 4:
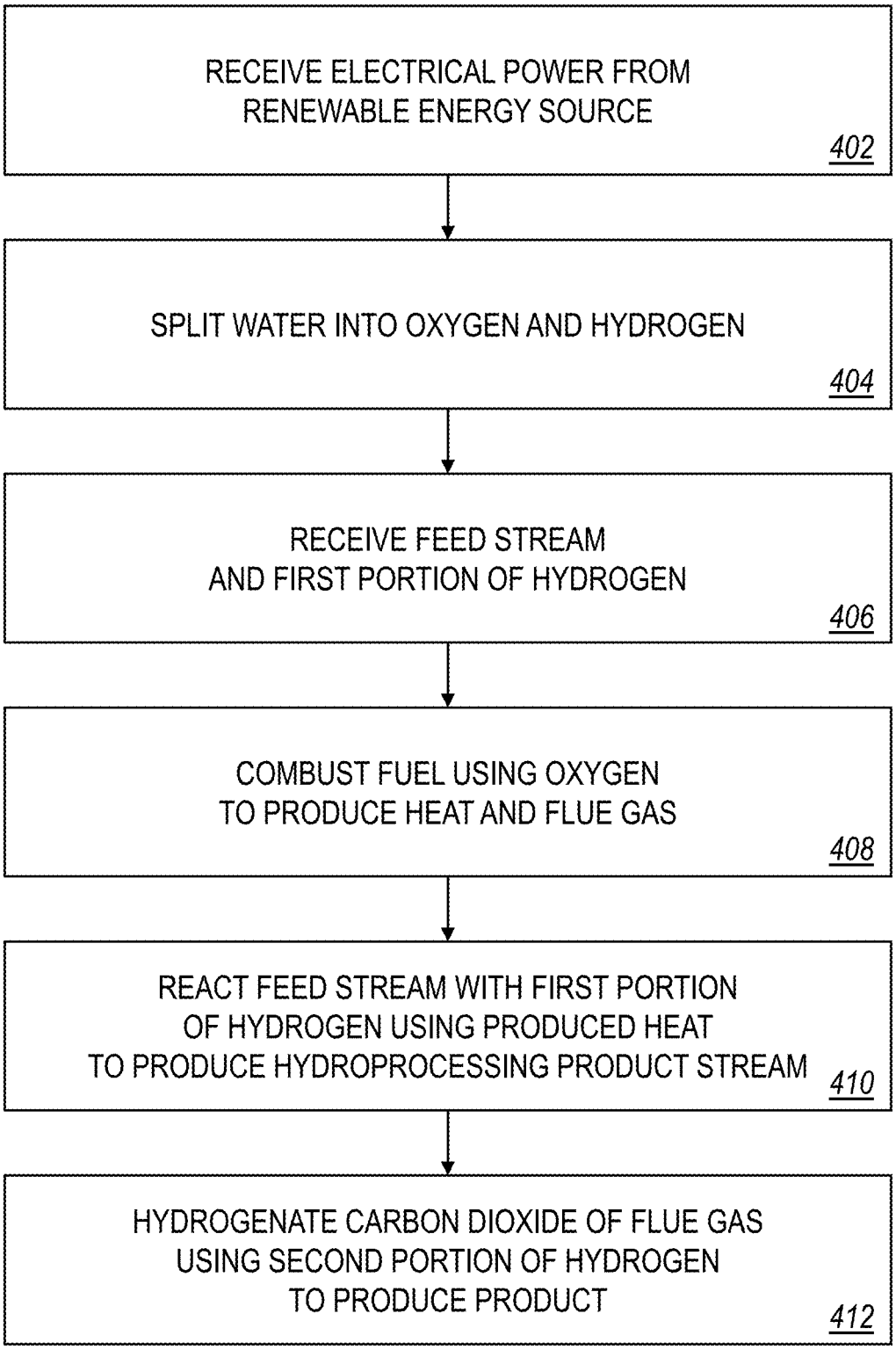
FIG. 4 is a flow chart of an example method that includes hydroprocessing for producing clean fuels and chemicals with a reduced carbon footprint.

FIG. 4 is a flow chart of an example method 400 that includes hydroprocessing for producing clean fuels and chemicals with a reduced carbon footprint. The system 200 can, for example, implement the method 400. At block 402, an electrolysis unit (such as the electrolysis unit 210) receives electrical power (such as the electrical power 213) derived from a renewable energy source (such as the renewable energy source 240). At block 404, the electrolysis unit 210 splits water (such as the water 211) into oxygen and hydrogen using the received electrical power 213 (block 402) to produce an oxygen stream (such as the oxygen stream 217) and a hydrogen stream (such as the hydrogen stream 215). The oxygen stream 217 includes the oxygen produced by the electrolysis unit 210 at block 404. The hydrogen stream 215 includes the hydrogen produced by the electrolysis unit 210 at block 404. At block 406, a hydroprocessing unit (such as the hydroprocessing unit 220) receives a feed stream (such as the feed stream 201) and a first portion (such as the first portion 215*a*) of the hydrogen stream 215 produced by the electrolysis unit 210 (block 404). The feed stream 201 includes a hydrocarbon oil. At block 408, the hydroprocessing unit 220 combusts a fuel (for example, methane) using at least a portion (such as the portion 217*a*) of the oxygen stream 217 produced by the electrolysis unit 210 (block 404) to produce heat and a flue gas (such as the flue gas 221). A furnace of the hydroprocessing unit 140 can combust the fuel using at least the portion 217*a* of the oxygen stream 217 at block 408 to produce heat and the flue gas 221. The flue gas 221 produced at block 408 includes carbon dioxide. At block 410, the hydroprocessing unit 220 reacts the feed stream 201 with the first portion 215*a* of the hydrogen stream 215 using the produced heat (block 408) to remove non-carbon impurities from the feed stream 201 and break a carbon-carbon bond of the hydrocarbon oil of the feed stream 201. A hydrotreater and/or hydrocracker of the hydroprocessing unit 140 can, for example, perform block 410 using the heat generated by the furnace of the hydroprocessing unit 140 at block 408. Reacting the feed stream 201 with the portion 215*a* of the hydrogen stream 215 at block 410 produces a hydroprocessing product stream (such as the hydroprocessing product stream 223). The hydroprocessing unit 220 can, for example, utilize electrical power 214 received from the renewable energy source 240 to perform block 410. The hydroprocessing product stream 223 produced at block 410 includes a saturated hydrocarbon. At block 412, at least a portion (such as the carbon dioxide stream 227) of the flue gas 221 is hydrogenated using a second portion (such as the portion 215*b*) of the hydrogen stream 215 produced by the electrolysis unit 210 (block 404) to produce a product stream (such as the product stream 231). The product stream 231 produced at block 412 includes a hydrocarbon, an oxygenate, or both.

EXAMPLES

Example 1

A mixture of disulfide oil (DSO), plastic waste including polypropylene, and vacuum residue were combined and fed to a gasifier. The elemental composition of the mixed feedstock and its components are provided in weight percentages (wt. %) in Table 1. The feedstock was gasified in the gasifier at 1045° C. The ratio of water-to-carbon was 0.6:1 by weight. The ratio of oxygen-to-carbon was 1:1 by weight. The raw syngas produced by the gasifier and steam were flowed to a water-gas shift reactor to increase the hydrogen yield in the product stream. The water-gas shift reactor was operated at 318° C. and 100 kPa. The molar ratio of steam-to-carbon monoxide was 3:1. 221.1 kilograms (kg) of hydrogen was obtained from the shift reaction. Table 2 provides the mass flow rates (in kg per hour (kg/h)) of the process streams entering the gasifier, exiting the gasifier, entering the water-gas shift reactor, and exiting the water-gas shift reactor.

TABLE 1

Elemental composition of feedstock components

| | DSO | Polypropylene | Vacuum Residue |
|---|---|---|---|
| Composition, wt. % | 10 | 10 | 80 |
| C, wt. % | 34.13 | 85.71 | 84.33 |
| H, wt. % | 7.51 | 14.29 | 10.43 |

TABLE 1-continued

Elemental composition of feedstock components

| | DSO | Polypropylene | Vacuum Residue |
|---|---|---|---|
| S, wt. % | 58.36 | 0.00 | 4.25 |
| N, wt. % | 0.00 | 0.00 | 0.00 |
| O, wt. % | 0.00 | 0.00 | 0.00 |
| Ash, wt. % | 0.00 | 0.00 | 0.00 |

TABLE 2

Compositions of process streams for Example 1

| | Molecular | Gasifier | | Water-Gas Shift Reactor | |
|---|---|---|---|---|---|
| Component | Weight | In, kg/h | Out, kg/h | In, kg/h | Out, kg/h |
| Hydrocarbon | | 1000 | | | |
| Sulfur | | | | | |
| Oxygen | 32 | 1000 | | | |
| Methane | 16 | | 9.8 | 9.8 | 9.8 |
| Hydrogen | 2 | | 113.2 | 113.2 | 221.2 |
| Carbon monoxide | 28 | | 1569.7 | 1569.7 | 69.4 |
| Carbon dioxide | 44 | | 346.8 | 346.8 | 2704.3 |
| Water | 18 | 476.7 | 163.2 | 2864.0 | 617.4 |
| Hydrogen sulfide | 34 | | 88.3 | 88.3 | 88.3 |
| Carbonyl sulfide | 60 | | 17.3 | 17.3 | 17.3 |

Example 2

The feedstock included straight-run diesel from Arab light crude oil, boiling in the range 180° C. to 370° C. and containing 1 wt. % sulfur and 50 parts per million by weight (ppmw) of nitrogen. 10,000 kg of diesel feedstock was hydrodesulfurized using renewable hydrogen for hydrodesulfurization reactions and renewable oxygen for the fuel combustion in the furnaces. The operating temperature of the hydrodesulfurization unit was 350° C. The operating pressure of the hydrodesulfurization unit was 4,500 kPa. The hydrogen-to-oil ratio in the hydrodesulfurization unit was 300 StL/L. The liquid hourly space velocity of the feedstock in the hydrodesulfurization unit was 1 $h^{-1}$. The hydrodesulfurization unit processed the feedstock to produce a diesel product containing 10 ppmw of sulfur. The hydroprocessed product was sent to a product separation unit to recover light gases and desulfurized products. The carbon dioxide-rich flue gas stream was flowed to a carbon dioxide capture system to capture and obtain purified carbon dioxide, which was then flowed to a hydrogenation unit. The hydrogen and carbon dioxide mixture, at a molar ratio of hydrogen to carbon dioxide of 4:1, was pressurized to 5 megapascals (MPa) (hydrogen partial pressure of 5 MPa and carbon dioxide partial pressure of 1.25 Mpa) and heated to 300° C. This pressurized stream was flowed to the hydrogenation unit containing Indium-Cobalt catalyst and processed at a weighted hourly space velocity of 2 $h^{-1}$ (gas liquid hourly space velocity of 15,000 $h^{-1}$). The once-through methanol yield was 17 wt. %. The unreacted carbon dioxide and hydrogen were recycled back to the hydrogenation unit for full conversion. The material balance for the process of Example 2 is summarized in Table 3. The process streams in Table 3 are identified with analogous reference numbers to the process streams of the system 200 shown in FIG. 2.

TABLE 3

Material balance summary for Example 2

| Reference # | Description | Units | Mass flow (kg) |
|---|---|---|---|
| 211 | Water to electrolysis | kg | 10,000 |
| 213 | Energy to electrolysis | kilowatts | 62,338 |
| 214 | Energy to hydroprocessing | kilowatts | 48,228 |
| 215 | Hydrogen from electrolysis | kg | 1,119 |
| 217 | Oxygen from electrolysis | kg | 8,889 |
| | Excess hydrogen | kg | 713 |
| 215a | Hydrogen to hydroprocessing | kg | 213 |
| 201 | Hydroprocessing feed | kg | 10,000 |
| 217a | Oxygen to hydroprocessing | kg | 8,889 |
| 223 | Hydroprocessing product | kg | 10,000 |
| 221 | Flue gas | kg | 143 |
| 215b | Hydrogen to hydrogenation | kg | 192 |
| 227 | Carbon dioxide | kg | 4,200 |
| 233 | Water and contaminants | kg | 1,718 |
| 231 | Methanol | kg | 3,055 |

EMBODIMENTS

In an example implementation (or aspect), a method comprises: receiving, by an electrolysis unit, electrical power derived from a renewable energy source; splitting, by the electrolysis unit, water into oxygen and hydrogen using the received electrical power to produce an oxygen stream comprising the oxygen and a hydrogen stream comprising the hydrogen; partially oxidizing, by a gasification unit, a gasification feed stream using at least a portion of the oxygen stream to produce a syngas stream comprising carbon dioxide, carbon monoxide, and hydrogen, wherein the gasification feed stream comprises consumer waste plastics, a waste stream from a hydrocarbon refinery, or both, wherein the hydrocarbon refinery is configured to receive crude oil and separate the crude oil into a plurality of components, wherein at least one of the plurality of components is the waste stream; reacting, by a water-gas shift unit, at least a portion of the carbon monoxide of the syngas stream with water to produce additional carbon dioxide and hydrogen, thereby producing a shifted syngas stream that has a greater hydrogen content than the syngas stream; reacting, by a hydroprocessing unit, a hydrocarbon feed stream with at least a portion of the hydrogen of the shifted syngas stream and a first portion of the hydrogen stream produced by the electrolysis unit to remove non-carbon impurities from the hydrocarbon feed stream and break carbon-carbon bonds in the hydrocarbon feed stream, thereby producing a hydroprocessing product stream comprising a saturated hydrocarbon; and hydrogenating, by a hydrogenation reactor, at least a portion of the carbon dioxide of the shifted syngas stream using a second portion of the hydrogen stream produced by the electrolysis unit to produce a product stream comprising a hydrocarbon, an oxygenate, or both.

In an example implementation (or aspect) combinable with any other example implementation (or aspect), the consumer waste plastics comprise polystyrene, polyphenylene, poly(p-xylene), poly(phenylenevinylene), polybenzyl-type polymer, polyethene, polyethylene terephthalate, polyolefin, polypropylene, polyvinyl chloride, polyamide, polycarbonate, polyurethane, polyester, natural rubber, synthetic rubber, acrylonitrile butadiene styrene, polyethylene/acrylonitrile butadiene styrene, polycarbonate/acrylonitrile butadiene styrene, maleimide/bismaleimide, melamine formaldehyde, phenol formaldehyde, polyepoxide, polyetheretherketone, polyetherimide, polyimide, polylactic acid, polymethyl methacrylate, polytetrafluoroethylene, urea-formaldehyde, diphenylcarbonate, polyether sulfone, polyacrylonitrile, or any combinations thereof.

In an example implementation (or aspect) combinable with any other example implementation (or aspect), the waste stream from the hydrocarbon refinery comprises a mercaptan oxidation waste stream comprising disulfide oil, a delayed coking waste stream comprising fuel grade coke, a vacuum distillation waste stream comprising vacuum residue, a solvent deasphalting waste stream comprising asphalt, an aromatics recovery waste stream comprising aromatics recovery bottoms, fuel oil, residual oil, tar, wax, or any combinations thereof.

In an example implementation (or aspect) combinable with any other example implementation (or aspect), the method further comprises deriving the electrical power from the renewable energy source, wherein the renewable energy source comprises solar energy, wind energy, tidal energy, hydropower, geothermal energy, or any combinations thereof.

In an example implementation (or aspect) combinable with any other example implementation (or aspect), the carbon dioxide of the shifted syngas stream is hydrogenated at a hydrogenation operating temperature in a range of from about 150 degrees Celsius (° C.) to about 450° C.

In an example implementation (or aspect) combinable with any other example implementation (or aspect), the carbon dioxide of the shifted syngas stream is hydrogenated at a hydrogenation operating pressure in a range of from about 200 kilopascals (kPa) to about 6,000 kPa.

In an example implementation (or aspect) combinable with any other example implementation (or aspect), a hydrogen-to-carbon dioxide molar ratio of the second portion of the hydrogen stream and the carbon dioxide of the shifted syngas stream entering the hydrogenation reactor is in a range of from about 2:1 to about 10:1.

In an example implementation (or aspect) combinable with any other example implementation (or aspect), the second portion of the hydrogen stream and the carbon dioxide of the shifted syngas stream have a gas hourly space velocity in the hydrogenation reactor in a range of from about 5,000 per hour ($h^{-1}$) to about 30,000 $h^{-1}$.

In an example implementation (or aspect) combinable with any other example implementation (or aspect), the gasification feed stream is partially oxidized by the gasification unit at a gasification operating pressure in a range of from about 2,000 kilopascals (kPa) to about 6,000 kPa.

In an example implementation (or aspect) combinable with any other example implementation (or aspect), the gasification feed stream is partially oxidized by the gasification unit at a gasification operating temperature in a range of from about 800 degrees Celsius (° C.) to about 1,800° C.

In an example implementation (or aspect) combinable with any other example implementation (or aspect), an oxygen-to-carbon molar ratio of the portion of the oxygen stream entering the gasification unit in relation to the gasification feed stream entering the gasification unit in a range of from about 1:25 to about 2:1.

In an example implementation (or aspect) combinable with any other example implementation (or aspect), the gasification feed stream comprises steam, and the gasification feed stream entering the gasification unit has a steam-to-carbon weight ratio in a range of from about 1:100 to about 10:1.

In an example implementation (or aspect) combinable with any other example implementation (or aspect), the hydrocarbon feed stream is reacted with at least the portion of the hydrogen of the shifted syngas stream and the first portion of the hydrogen stream at a hydroprocessing operating temperature in a range of from about 150° C. to about 450° C.

In an example implementation (or aspect) combinable with any other example implementation (or aspect), the hydrocarbon feed stream is reacted with at least the portion of the hydrogen of the shifted syngas stream and the first portion of the hydrogen stream at a hydroprocessing operating pressure in a range of from about 2,000 kPa to about 20,000 kPa.

In an example implementation (or aspect) combinable with any other example implementation (or aspect), the hydrocarbon feed stream has a liquid hourly space velocity in the hydroprocessing unit in a range of from about 0.1 per hour ($h^{-1}$) to about 10 $h^{-1}$.

In an example implementation (or aspect), a system comprises: an electrolysis unit configured to receive a water stream and electrical power derived from a renewable energy source, the electrolysis unit configured to use the electrical power to perform electrolysis on the water stream to produce an oxygen stream comprising oxygen and a hydrogen stream comprising hydrogen; a gasification unit configured to receive a gasification feed stream comprising consumer waste plastics, a waste stream from a hydrocarbon refinery, or both, the gasification unit configured to partially oxidize the gasification feed stream using at least a portion of the oxygen stream produced by the electrolysis unit to produce a syngas stream comprising carbon dioxide, carbon monoxide, and hydrogen; a water-gas shift unit configured to receive the syngas stream from the gasification unit, the water-gas shift unit configured to react at least a portion of the carbon monoxide of the syngas stream with water to produce additional carbon dioxide and hydrogen, thereby producing a shifted syngas stream, wherein the shifted syngas stream has a greater hydrogen content in comparison with the syngas stream; a hydroprocessing unit configured to receive a hydrocarbon feed stream, at least a portion of the hydrogen of the shifted syngas stream, and a first portion of the hydrogen stream produced by the electrolysis unit, the hydroprocessing unit configured to react the hydrocarbon feed stream with the hydrogen of the shifted syngas stream and the first portion of the hydrogen stream to remove non-carbon impurities from the hydrocarbon feed stream and break carbon-carbon bonds in the hydrocarbon feed stream, thereby producing a hydroprocessing product stream comprising a saturated hydrocarbon; and a hydrogenation unit configured to receive at least a portion of the carbon dioxide of the shifted syngas stream and a second portion of the hydrogen stream produced by the electrolysis unit, the hydrogenation unit configured to hydrogenate at least the portion of the carbon dioxide of the shifted syngas stream using the second portion of the hydrogen stream, thereby producing a product stream comprising a hydrocarbon, an oxygenate, or both.

In an example implementation (or aspect) combinable with any other example implementation (or aspect), the system further comprises the gasification feed stream, wherein the consumer waste plastics comprise polystyrene, polyphenylene, poly(p-xylene), poly(phenylenevinylene), polybenzyl-type polymer, polyethene, polyethylene terephthalate, polyolefin, polypropylene, polyvinyl chloride, polyamide, polycarbonate, polyurethane, polyester, natural rubber, synthetic rubber, acrylonitrile butadiene styrene, polyethylene/acrylonitrile butadiene styrene, polycarbonate/acrylonitrile butadiene styrene, maleimide/bismaleimide, melamine formaldehyde, phenol formaldehyde, polyepoxide, polyetheretherketone, polyetherimide, polyimide, polylactic acid, polymethyl methacrylate, polytetrafluoroethylene, urea-formaldehyde, diphenylcarbonate, polyether sulfone, polyacrylonitrile, or any combinations thereof.

In an example implementation (or aspect) combinable with any other example implementation (or aspect), the system further comprises the hydrocarbon refinery, wherein the hydrocarbon refinery is configured to receive and separate crude oil into a plurality of components, wherein at least one of the plurality of components is the waste stream, wherein the waste stream from the hydrocarbon refinery comprises a mercaptan oxidation waste stream comprising disulfide oil, a delayed coking waste stream comprising fuel grade coke, a vacuum distillation waste stream comprising vacuum residue, a solvent deasphalting waste stream comprising asphalt, an aromatics recovery waste stream comprising aromatics recovery bottoms, fuel oil, residual oil, tar, wax, or any combinations thereof.

In an example implementation (or aspect) combinable with any other example implementation (or aspect), the system further comprises the electrical power derived from the renewable energy source, wherein the renewable energy source comprises solar energy, wind energy, tidal energy, hydropower, geothermal energy, or any combinations thereof.

In an example implementation (or aspect) combinable with any other example implementation (or aspect), the hydrogenation reactor is configured to hydrogenate at least the portion of the carbon dioxide of the shifted syngas stream at a hydrogenation operating temperature in a range of from about 150° C. to about 450° C.

In an example implementation (or aspect) combinable with any other example implementation (or aspect), the hydrogenation reactor is configured to hydrogenate at least the portion of the carbon dioxide of the shifted syngas stream at a hydrogenation operating pressure in a range of from about 200 kPa to about 6,000 kPa.

In an example implementation (or aspect) combinable with any other example implementation (or aspect), a hydrogen-to-carbon dioxide molar ratio of the second portion of the hydrogen stream and the carbon dioxide of the shifted syngas stream entering the hydrogenation reactor is in a range of from about 2:1 to about 10:1.

In an example implementation (or aspect) combinable with any other example implementation (or aspect), the second portion of the hydrogen stream and the carbon dioxide of the shifted syngas stream have a gas hourly space velocity in the hydrogenation reactor in a range of from about 5,000 per hour ($h^{-1}$) to about 30,000 $h^{-1}$.

In an example implementation (or aspect) combinable with any other example implementation (or aspect), the gasification unit is configured to partially oxidize the gasification feed stream at a gasification operating pressure in a range of from about 2,000 kilopascals (kPa) to about 6,000 kPa.

In an example implementation (or aspect) combinable with any other example implementation (or aspect), the gasification unit is configured to partially oxidize the gasification feed stream at a gasification operating temperature in a range of from about 800 degrees Celsius (° C.) to about 1,800° C.

In an example implementation (or aspect) combinable with any other example implementation (or aspect), an oxygen-to-carbon molar ratio of the portion of the oxygen stream entering the gasification unit in relation to the gasification feed stream entering the gasification unit in a range of from about 1:25 to about 2:1.

In an example implementation (or aspect) combinable with any other example implementation (or aspect), the gasification feed stream comprises steam, and the gasification feed stream entering the gasification unit has a steam-to-carbon weight ratio in a range of from about 1:100 to about 10:1.

In an example implementation (or aspect) combinable with any other example implementation (or aspect), the hydroprocessing unit comprises a hydrotreater, a hydrocracker, or both.

In an example implementation (or aspect) combinable with any other example implementation (or aspect), the hydroprocessing unit is configured to operate at a hydroprocessing operating temperature in a range of from about 150° C. to about 450° C.

In an example implementation (or aspect) combinable with any other example implementation (or aspect), the hydroprocessing unit is configured to operate at a hydroprocessing operating pressure in a range of from about 2,000 kPa to about 20,000 kPa.

In an example implementation (or aspect) combinable with any other example implementation (or aspect), the hydrocarbon feed stream has a liquid hourly space velocity in the hydroprocessing unit in a range of from about 0.1 per hour ($h^{-1}$) to about 10 $h^{-1}$.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

receiving, by an electrolysis unit, electrical power derived from a renewable energy source;

splitting, by the electrolysis unit, water into oxygen and hydrogen using the received electrical power to produce an oxygen stream comprising the oxygen and a hydrogen stream comprising the hydrogen;

partially oxidizing, by a gasification unit, a gasification feed stream using at least a portion of the oxygen stream to produce a syngas stream comprising carbon dioxide, carbon monoxide, and hydrogen, wherein the gasification feed stream comprises consumer waste plastics, a waste stream from a hydrocarbon refinery, or both, wherein the hydrocarbon refinery is configured to receive crude oil and separate the crude oil into a plurality of components, wherein at least one of the plurality of components is the waste stream;

reacting, by a water-gas shift unit, at least a portion of the carbon monoxide of the syngas stream with water to produce additional carbon dioxide and hydrogen, thereby producing a shifted syngas stream that has a greater hydrogen content than the syngas stream;

reacting, by a hydroprocessing unit, a hydrocarbon feed stream with at least a portion of the hydrogen of the shifted syngas stream and a first portion of the hydrogen stream produced by the electrolysis unit to remove non-carbon impurities from the hydrocarbon feed stream and break carbon-carbon bonds in the hydrocarbon feed stream, thereby producing a hydroprocessing product stream comprising a saturated hydrocarbon; and hydrogenating, by a hydrogenation reactor, at least a portion of the carbon dioxide of the shifted syngas stream using a second portion of the hydrogen stream produced by the electrolysis unit to produce a product stream comprising a hydrocarbon, an oxygenate, or both.

2. The method of claim 1, wherein the consumer waste plastics comprise polystyrene, polyphenylene, poly(p-xylene), poly(phenylenevinylene), polybenzyl-type polymer, polyethene, polyethylene terephthalate, polyolefin, polypropylene, polyvinyl chloride, polyamide, polycarbonate, polyurethane, polyester, natural rubber, synthetic rubber, acrylonitrile butadiene styrene, polyethylene/acrylonitrile butadiene styrene, polycarbonate/acrylonitrile butadiene styrene, maleimide/bismaleimide, melamine formaldehyde, phenol formaldehyde, polyepoxide, polyetheretherketone, polyetherimide, polyimide, polylactic acid, polymethyl methacrylate, polytetrafluoroethylene, urea-formaldehyde, diphenylcarbonate, polyether sulfone, polyacrylonitrile, or any combinations thereof.

3. The method of claim 2, wherein the waste stream from the hydrocarbon refinery comprises a mercaptan oxidation waste stream comprising disulfide oil, a delayed coking waste stream comprising fuel grade coke, a vacuum distillation waste stream comprising vacuum residue, a solvent deasphalting waste stream comprising asphalt, an aromatics recovery waste stream comprising aromatics recovery bottoms, fuel oil, residual oil, tar, wax, or any combinations thereof.

4. The method of claim 3, further comprising deriving the electrical power from the renewable energy source, wherein the renewable energy source comprises solar energy, wind energy, tidal energy, hydropower, geothermal energy, or any combinations thereof.

5. The method of claim 4, wherein the carbon dioxide of the shifted syngas stream is hydrogenated at a hydrogenation operating temperature in a range of from about 150 degrees Celsius (° C.) to about 450° C. and a hydrogenation operating pressure in a range of from about 200 kilopascals (kPa) to about 6,000 kPa, a hydrogen-to-carbon dioxide molar ratio of the second portion of the hydrogen stream and the carbon dioxide of the shifted syngas stream entering the hydrogenation reactor is in a range of from about 2:1 to about 10:1, and the second portion of the hydrogen stream and the carbon dioxide of the shifted syngas stream have a gas hourly space velocity in the hydrogenation reactor in a range of from about 5,000 per hour ($h^{-1}$) to about 30,000 $h^{-1}$.

6. The method of claim 4, wherein the gasification feed stream is partially oxidized by the gasification unit at a gasification operating pressure in a range of from about 2,000 kilopascals (kPa) to about 6,000 kPa and a gasification operating temperature in a range of from about 800 degrees Celsius (° C.) to about 1,800° C.

7. The method of claim 6, wherein an oxygen-to-carbon molar ratio of the portion of the oxygen stream entering the gasification unit in relation to the gasification feed stream entering the gasification unit in a range of from about 1:25 to about 2:1.

8. The method of claim 6, wherein the gasification feed stream comprises steam, and the gasification feed stream entering the gasification unit has a steam-to-carbon weight ratio in a range of from about 1:100 to about 10:1.

9. The method of claim 4, wherein the hydrocarbon feed stream is reacted with at least the portion of the hydrogen of the shifted syngas stream and the first portion of the hydrogen stream at a hydroprocessing operating temperature in a range of from about 150° C. to about 450° C. and a hydroprocessing operating pressure in a range of from about 2,000 kPa to about 20,000 kPa.

10. The method of claim 9, wherein the hydrocarbon feed stream has a liquid hourly space velocity in the hydroprocessing unit in a range of from about 0.1 per hour ($h^{-1}$) to about 10 $h^{-1}$.

11. A system comprising:

an electrolysis unit configured to receive a water stream and electrical power derived from a renewable energy source, the electrolysis unit configured to use the electrical power to perform electrolysis on the water stream to produce an oxygen stream comprising oxygen and a hydrogen stream comprising hydrogen;

a gasification unit configured to receive a gasification feed stream comprising consumer waste plastics, a waste stream from a hydrocarbon refinery, or both, the gasification unit configured to partially oxidize the gasification feed stream using at least a portion of the oxygen stream produced by the electrolysis unit to produce a syngas stream comprising carbon dioxide, carbon monoxide, and hydrogen;

a water-gas shift unit configured to receive the syngas stream from the gasification unit, the water-gas shift unit configured to react at least a portion of the carbon monoxide of the syngas stream with water to produce additional carbon dioxide and hydrogen, thereby producing a shifted syngas stream, wherein the shifted syngas stream has a greater hydrogen content in comparison with the syngas stream;

a hydroprocessing unit configured to receive a hydrocarbon feed stream, at least a portion of the hydrogen of the shifted syngas stream, and a first portion of the hydrogen stream produced by the electrolysis unit, the hydroprocessing unit configured to react the hydrocarbon feed stream with the hydrogen of the shifted syngas stream and the first portion of the hydrogen stream to remove non-carbon impurities from the hydrocarbon feed stream and break carbon-carbon bonds in the hydrocarbon feed stream, thereby producing a hydroprocessing product stream comprising a saturated hydrocarbon; and a hydrogenation unit configured to receive at least a portion of the carbon dioxide of the shifted syngas stream and a second portion of the hydrogen stream produced by the electrolysis unit, the hydrogenation unit configured to hydrogenate at least the portion of the carbon dioxide of the shifted syngas stream using the second portion of the hydrogen stream, thereby producing a product stream comprising a hydrocarbon, an oxygenate, or both.

12. The system of claim 11, further comprising the gasification feed stream, wherein the consumer waste plastics comprise polystyrene, polyphenylene, poly(p-xylene), poly(phenylenevinylene), polybenzyl-type polymer, polyethene, polyethylene terephthalate, polyolefin, polypropylene, polyvinyl chloride, polyamide, polycarbonate, polyurethane, polyester, natural rubber, synthetic rubber, acrylonitrile butadiene styrene, polyethylene/acrylonitrile butadiene styrene, polycarbonate/acrylonitrile butadiene styrene, maleimide/bismaleimide, melamine formaldehyde, phenol formaldehyde, polyepoxide, polyetheretherketone, polyetherimide, polyimide, polylactic acid, polymethyl methacrylate, polytetrafluoroethylene, urea-formaldehyde, diphenylcarbonate, polyether sulfone, polyacrylonitrile, or any combinations thereof.

13. The system of claim 12, further comprising the hydrocarbon refinery, wherein the hydrocarbon refinery is configured to receive and separate crude oil into a plurality of components, wherein at least one of the plurality of components is the waste stream, wherein the waste stream from the hydrocarbon refinery comprises a mercaptan oxidation waste stream comprising disulfide oil, a delayed coking waste stream comprising fuel grade coke, a vacuum distillation waste stream comprising vacuum residue, a solvent deasphalting waste stream comprising asphalt, an aromatics recovery waste stream comprising aromatics recovery bottoms, fuel oil, residual oil, tar, wax, or any combinations thereof.

14. The system of claim 13, further comprising the electrical power derived from the renewable energy source, wherein the renewable energy source comprises solar energy, wind energy, tidal energy, hydropower, geothermal energy, or any combinations thereof.

15. The system of claim 14, wherein the hydrogenation reactor is configured to hydrogenate at least the portion of the carbon dioxide of the shifted syngas stream at a hydrogenation operating temperature in a range of from about 150° C. to about 450° C. and a hydrogenation operating pressure in a range of from about 200 kPa to about 6,000 kPa, a hydrogen-to-carbon dioxide molar ratio of the second portion of the hydrogen stream and the carbon dioxide of the shifted syngas stream entering the hydrogenation reactor is in a range of from about 2:1 to about 10:1, and the second portion of the hydrogen stream and the carbon dioxide of the shifted syngas stream have a gas hourly space velocity in the hydrogenation reactor in a range of from about 5,000 per hour ($h^{-1}$) to about 30,000 $h^{-1}$.

16. The system of claim 14, wherein the gasification unit is configured to partially oxidize the gasification feed stream at a gasification operating pressure in a range of from about 2,000 kilopascals (kPa) to about 6,000 kPa and a gasification operating temperature in a range of from about 800 degrees Celsius (° C.) to about 1,800° C., and an oxygen-to-carbon molar ratio of the portion of the oxygen stream entering the gasification unit in relation to the gasification feed stream entering the gasification unit in a range of from about 1:25 to about 2:1.

17. The system of claim 16, wherein the gasification feed stream comprises steam, and the gasification feed stream entering the gasification unit has a steam-to-carbon weight ratio in a range of from about 1:100 to about 10:1.

18. The system of claim 14, wherein the hydroprocessing unit comprises a hydrotreater, a hydrocracker, or both, and the hydroprocessing unit is configured to operate at a hydroprocessing operating temperature in a range of from about 150° C. to about 450° C. and a hydroprocessing operating pressure in a range of from about 2,000 kPa to about 20,000 kPa.

19. The system of claim 18, wherein the hydrocarbon feed stream has a liquid hourly space velocity in the hydroprocessing unit in a range of from about 0.1 per hour ($h^{-1}$) to about 10 $h^{-1}$.

* * * * *